US010460919B2

(12) United States Patent
Yip et al.

(10) Patent No.: US 10,460,919 B2
(45) Date of Patent: Oct. 29, 2019

(54) AUTOMATED DETERMINATION OF MASS SPECTROMETER COLLISION ENERGY

(71) Applicant: Thermo Finnigan LLC, San Jose, CA (US)

(72) Inventors: Ping F. Yip, Salem, MA (US); Helene L. Cardasis, Mountain View, CA (US); James L. Stephenson, Jr., Raleigh, NC (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 15/975,634

(22) Filed: May 9, 2018

(65) Prior Publication Data

US 2018/0350578 A1 Dec. 6, 2018

Related U.S. Application Data

(60) Provisional application No. 62/513,918, filed on Jun. 1, 2017.

(51) Int. Cl.
*H01J 49/00* (2006.01)

(52) U.S. Cl.
CPC ..... *H01J 49/0045* (2013.01); *H01J 49/005* (2013.01); *H01J 49/0031* (2013.01)

(58) Field of Classification Search
CPC ... H01J 49/0045; H01J 49/0031; H01J 49/005
(Continued)

(56) References Cited

U.S. PATENT DOCUMENTS 6,124,591 A 9/2000 Schwartz et al.
2006/0255294 A1* 11/2006 Martin, III ..... H01J 49/06 250/492.3

(Continued)

FOREIGN PATENT DOCUMENTS

EP 2775509 A2 9/2014
EP 3193352 A1 7/2017

(Continued)

OTHER PUBLICATIONS

Anderson L. et al.: "Identification and Characterization of Human Proteoforms by Top-Down LC-21 Tesla FT-ICR Mass Spectrometry" Journal of Proteome Research (2017), 16 (2), pp. 1087-1096.

(Continued)

*Primary Examiner* — Nicole M Ippolito
(74) *Attorney, Agent, or Firm* — Thomas F. Cooney

(57) ABSTRACT

The present disclosure establishes new dissociation parameters that may be used to determine the collision energy (CE) needed to achieve a desired extent of dissociation for a given analyte precursor ion using collision cell type collision-induced dissociation. This selection is based solely on the analyte precursor ion's molecular weight, MW, and charge state, z. Metrics are proposed that may be used as a parameter for the "extent of dissociation", and then predictive models are developed of the CEs required to achieve a range of values for each metric. Each model is a simple smooth function of only MW and z of the precursor ion. Coupled with a real-time spectral deconvolution (m/z to mass) algorithm, methods in accordance with the invention enable control over the extent of dissociation through automated, real-time selection of collision energy in a precursor-dependent manner.

2 Claims, 21 Drawing Sheets

(58) Field of Classification Search
USPC ..... 250/281, 282, 283, 288
See application file for complete search history.

(56) References Cited

U.S. PATENT DOCUMENTS

| | | | | |
|---|---|---|---|---|
| 2007/0158546 | A1 | 7/2007 | Lock et al. | |
| 2008/0315082 | A1 | 12/2008 | Ogata et al. | |
| 2011/0295521 | A1 | 12/2011 | Satulovsky et al. | |
| 2012/0158318 | A1 | 6/2012 | Wright | |
| 2013/0045887 | A1* | 2/2013 | Zhang | G01N 33/54306 506/9 |
| 2013/0297230 | A1 | 11/2013 | Kawase | |
| 2015/0162175 | A1 | 6/2015 | Wright | |
| 2017/0178887 | A1* | 6/2017 | Park | G01N 27/622 |
| 2018/0136220 | A1* | 5/2018 | Grote | C12Q 1/68 |
| 2018/0166265 | A1* | 6/2018 | Geronnanos | G01N 30/72 |

FOREIGN PATENT DOCUMENTS

| | | | |
|---|---|---|---|
| EP | 2685487 | B1 | 5/2018 |
| GB | 2513973 | A | 11/2014 |
| WO | 2017/123440 | A1 | 7/2017 |

OTHER PUBLICATIONS

Levy, M. J. et al.: "Primary Sequence Confirmation of a Protein Therapeutic Using Top Down MS/MS and MS3", Analytical Chemistry (2015), 87 (14), pp. 6995-6999.

Mandal R. et al.: "Top-down characterization of proteins and drug-protein complexes using nanoelectrospray tandem spectrometry", Rapid Communications in Mass Spectrometry, 2006, 20 (1), pp. 48-52.

Randall, E. C. et al.: "Direct Analysis of Intact Proteins from *Escherichia coli* Colonies by Liquid Extraction Surface Analysis Mass Spectrometry", Analytical Chemistry (2014), 86 (21), pp. 10504-10510.

Liu et al., "Top-Down Protein Identification/Characterization of a Priori Unknown Proteins via Ion Trap Collision-Induced Dissociation and Ion/Ion Reactions in a Quadrupole/Time-of-Flight Tandem Mass Spectrometer", Anal. Chem. 2009, 81, pp. 1433-1441.

* cited by examiner 100
50
0
R.I.
(%)
A10
t1
t2
t3
A12
t4
A8
Retention Time 100
50
0
Relative Intensity (%)
A11
t5
A13
t6
t7
t8
A8
Retention Time Intensity (arbitrary)
78
76
m/z

TABLE 1

| Precursor Charge (z) | Factor |
|---|---|
| 1 | 1 |
| 2 | 0.9 |
| 3 | 0.85 |
| 4 | 0.8 |
| ≥5 | 0.75 |

TABLE 2

| Precursor Survival, $D_p$ (Percent) | *a*1 | *a*2 | *a*3 |
|---|---|---|---|
| 1 | 0.00470078 | -1.8820703 | 1.44351911 |
| 2 | 0.00464301 | -1.8902764 | 1.44249578 |
| 3 | 0.00459776 | -1.8971044 | 1.44162661 |
| 4 | 0.00456329 | -1.9027399 | 1.44089112 |
| 5 | 0.00453784 | -1.9073683 | 1.44026882 |
| 6 | 0.0045197 | -1.9111701 | 1.43973978 |
| 7 | 0.00450736 | -1.9143058 | 1.43928624 |
| 8 | 0.00449936 | -1.9169309 | 1.43889099 |
| 9 | 0.00449424 | -1.9192008 | 1.43853683 |
| 10 | 0.00449053 | -1.9212711 | 1.43820653 |
| 15 | 0.00447334 | -1.9308513 | 1.43666196 |
| 20 | 0.00446814 | -1.9386297 | 1.43532955 |
| 50 | 0.00454622 | -1.9755979 | 1.42792781 |

FIG. 6B

TABLE 3

| $D_e$ | *b*1 | *b*2 | *b*3 |
|---|---|---|---|
| 0.1 | 0.03929987 | -1.5314701 | 1.08690053 |
| 0.2 | 0.05394166 | -1.4162222 | 1.03482284 |
| 0.3 | 0.06411948 | -1.357906 | 1.00753659 |
| 0.4 | 0.07229396 | -1.3197634 | 0.98913378 |
| 0.5 | 0.07933121 | -1.2917429 | 0.97521669 |
| 0.6 | 0.08564912 | -1.2697276 | 0.96396574 |
| 0.7 | 0.09148209 | -1.2516553 | 0.95446493 |
| 0.8 | 0.09697853 | -1.2363531 | 0.94618879 |
| 0.9 | 0.10223907 | -1.2230954 | 0.93881014 |
| 1 | 0.10733599 | -1.2114043 | 0.93211223 |
| 1.1 | 0.11232501 | -1.2009492 | 0.92594327 |
| 1.2 | 0.11725044 | -1.1914937 | 0.92019345 |
| 1.3 | 0.12214901 | -1.1828638 | 0.91478086 |
| 1.4 | 0.1270532 | -1.1749287 | 0.90964218 |
| 1.5 | 0.13199199 | -1.1675894 | 0.90472816 |
| 1.6 | 0.13699306 | -1.1607707 | 0.89999942 |
| 1.7 | 0.14208352 | -1.1544175 | 0.89542448 |
| 1.8 | 0.14729118 | -1.1484927 | 0.89097846 |
| 1.9 | 0.15264588 | -1.1429787 | 0.88664267 |
| 2 | 0.15818156 | -1.1378844 | 0.88240572 |

FIG. 8B

TABLE 4

| z | f(z) | z | f(z) | z | f(z) | z | f(z) | z | f(z) |
|---|---|---|---|---|---|---|---|---|---|
| 1 | 1.0000 | 21 | 0.3992 | 41 | 0.3312 | 61 | 0.2964 | 81 | 0.2738 |
| 2 | 0.9000 | 22 | 0.3941 | 42 | 0.3290 | 62 | 0.2951 | 82 | 0.2729 |
| 3 | 0.8500 | 23 | 0.3892 | 43 | 0.3268 | 63 | 0.2937 | 83 | 0.2720 |
| 4 | 0.8000 | 24 | 0.3846 | 44 | 0.3247 | 64 | 0.2925 | 84 | 0.2711 |
| 5 | 0.7500 | 25 | 0.3803 | 45 | 0.3227 | 65 | 0.2912 | 85 | 0.2702 |
| 6 | 0.7000 | 26 | 0.3761 | 46 | 0.3207 | 66 | 0.2900 | 86 | 0.2693 |
| 7 | 0.6500 | 27 | 0.3722 | 47 | 0.3188 | 67 | 0.2887 | 87 | 0.2684 |
| 8 | 0.6000 | 28 | 0.3684 | 48 | 0.3169 | 68 | 0.2875 | 88 | 0.2676 |
| 9 | 0.5500 | 29 | 0.3648 | 49 | 0.3151 | 69 | 0.2864 | 89 | 0.2667 |
| 10 | 0.5000 | 30 | 0.3614 | 50 | 0.3133 | 70 | 0.2852 | 90 | 0.2659 |
| 11 | 0.4783 | 31 | 0.3581 | 51 | 0.3116 | 71 | 0.2841 | 91 | 0.2651 |
| 12 | 0.4668 | 32 | 0.3549 | 52 | 0.3099 | 72 | 0.2830 | 92 | 0.2643 |
| 13 | 0.4565 | 33 | 0.3519 | 53 | 0.3083 | 73 | 0.2819 | 93 | 0.2635 |
| 14 | 0.4471 | 34 | 0.349 | 54 | 0.3067 | 74 | 0.2808 | 94 | 0.2627 |
| 15 | 0.4386 | 35 | 0.3461 | 55 | 0.3051 | 75 | 0.2798 | 95 | 0.2619 |
| 16 | 0.4307 | 36 | 0.3434 | 56 | 0.3036 | 76 | 0.2787 | 96 | 0.2611 |
| 17 | 0.4235 | 37 | 0.3408 | 57 | 0.3021 | 77 | 0.2777 | 97 | 0.2604 |
| 18 | 0.4168 | 38 | 0.3383 | 58 | 0.3006 | 78 | 0.2767 | 98 | 0.2596 |
| 19 | 0.4105 | 39 | 0.3358 | 59 | 0.2992 | 79 | 0.2758 | 99 | 0.2589 |
| 20 | 0.4047 | 40 | 0.3335 | 60 | 0.2978 | 80 | 0.2748 | 100 | 0.2582 |

FIG. 11

AUTOMATED DETERMINATION OF MASS SPECTROMETER COLLISION ENERGY

CROSS REFERENCE TO RELATED APPLICATION

This application claims priority to and the benefit of the filing date, under 35 U.S.C. 119(e), of co-pending U.S. Provisional Application for Patent No. 62/513,918, filed on Jun. 1, 2017 and titled "Automated Determination of Mass Spectrometer Collision Energy", said Provisional application assigned to the assignee of the present invention and incorporated herein by reference in its entirety.

TECHNICAL FIELD

The present invention relates to mass spectrometry and, more particularly, relates to methods and apparatuses for mass spectrometry analysis of complex mixtures of proteins or polypeptides by tandem mass spectrometry. More particularly, the present invention relates to such methods and apparatuses that employ collision-induced dissociation to fragment precursor ions and in which automatic determinations are made regarding the selection of precursor ions to be fragmented and the magnitude of collision energies to be imparted to the selected precursor ions.

BACKGROUND ART

The study of proteins in living cells and in tissues (proteomics) is an active area of clinical and basic scientific research because metabolic control m cells and tissues is exercised at the protein level. For example, comparison of the levels of protein expression between healthy and diseased tissues, or between pathogenic and nonpathogenic microbial strains, can speed the discovery and development of new drug compounds or agricultural products. Further, analysis of the protein expression pattern in diseased tissues or in tissues excised from organisms undergoing treatment can also serve as diagnostics of disease states or the efficacy of treatment strategies, as well as provide prognostic information regarding suitable treatment modalities and therapeutic options for individual patients. Still further, identification of sets of proteins in samples derived from microorganisms (e.g., bacteria) can provide a means to identify the species and/or strain of microorganism as well as, with regard to bacteria, identify possible drug resistance properties of such species or strains.

Because it can used to provide detailed protein and peptide structural information, mass spectrometry (MS) is currently considered to be a valuable analytical tool for biochemical mixture analysis and protein identification. Conventional methods of protein analysts therefore often combine two-dimensional (2D) gel electrophoresis, for separation and quantification, with mass spectrometric identification of proteins. Also, capillary liquid chromatography as well as various other "front-end" separation or chemical fractionation techniques have been combined with electrospray ionization tandem mass spectrometry for large-scale protein identification without gel electrophoresis. Using mass spectrometry, qualitative differences between mass spectra can be identified, and proteins corresponding to peaks occurring in only some of the spectra serve as candidate biological markers.

The term "top-down proteomics" refers to methods of analysis in which protein samples are introduced intact into a mass spectrometer, without prior enzymatic, chemical or other means of digestion. Top-down analysis enables the study of the intact proteins, allowing identification, primary structure determination and localization of post-translational modifications (PTMs) directly at the protein level. Top-down proteomic analysis typically consists of introducing an intact protein into the ionization source of a mass spectrometer, determining the intact mass of the protein, fragmenting the protein ions and measuring the mass-to-charge ratios (m/z) and abundances of the various fragments so-generated This sequence of instrumental steps is commonly referred to as tandem mass spectrometry or, alternatively, "MS/MS" analysis. Such techniques may be advantageously employed for polypeptide studies. The resulting fragmentation is many times more complex than the fragmentation of simple peptides. The interpretation of such fragment mass spectra generally includes comparing the observed fragmentation pattern to either a protein sequence database that includes compiled experimental fragmentation results generated from known samples or, alternatively, to theoretically predicted fragmentation patterns. For example, Liu et al. ("Top-Down Protein Identification/Characterization of a Priori Unknown Proteins via Ion Trap Collision-Induced Dissociation and Ion/Ion Reactions in a Quadrupole/Time-of-Flight Tandem Mass Spectrometer", *Anal. Chem.* 2009, 81, 1433-1441) have described top-down protein identification and characterization of both modified and unmodified unknown proteins with masses up to ≈28 kDa.

An advantage of a top-down analysis over a bottom-up analysis is that a protein may be identified directly, rather than inferred as is the case with peptides in a so-called "bottom-up" analysis. Another advantage is that alternative forms of a protein, e.g. post-translational modifications and splice variants, may be identified. However, top-down analysis has a disadvantage when compared to a bottom-up analysis in that many proteins can be difficult to isolate and purify. Thus, each protein in an incompletely separated mixture can yield, upon mass spectrometric analysis, multiple ion species, each species corresponding to a different respective degree of protonation and a different respective charge state, and each such ion species can give rise to multiple isotopic variants. A single MS spectrum measured in a top-down analysis can easily contain hundreds to even thousands of peaks which belong to different analytes—all interwoven over a given m/z range in which the ion signals of very different intensities overlap.

Front-end sample fractionation, such as two-dimensional gel electrophoresis or liquid chromatography, when performed prior to MS analysis, can reduce the complexity of various individual mass spectra. Nonetheless, the mass spectra of such sample fractions may still comprise the signatures of multiple proteins and/or polypeptides. The general technique of conducting mass spectrometry (MS) analysis of ions generated from compounds separated by liquid chromatography (LC) may be referred to as "LC-MS". If the mass spectrometry analysis is conducted as tandem mass spectrometry (MS/MS), then the above-described procedure may be referred to as "LC-MS/MS". In conventional LC-MS/MS experiments a sample is initially analyzed by mass spectrometry to determine mass-to-charge ratios (m/z) of ions derived from a sample and to identify (i.e., select) mass spectral peaks of interest. The sample is then analyzed further by product ion MS/MS scans on the selected peak(s). More specifically, in a first stage of analysis, frequently referred to as "MS1", a full-scan mass spectrum, comprising an initial survey scan, is obtained. This full-scan spectrum is then followed by the selection of one or more precursor ion species. The precursor ions of the selected species are subjected to fragmentation such as may be accomplished employing a collision cell or employing another form of fragmentation cell such as surface-induced dissociation, electron-transfer dissociation or photo-dissociation. In a second stage, the resulting fragment (product) ions are detected for further analysis (frequently referred to as either "MS/MS" or "MS2") using either the same or a second mass analyzer. A resulting product spectrum exhibits a set of fragmentation peaks (a fragment set) which, in many instances, may be used as a means to derive structural information relating to the precursor ion species.

FIG. 1A illustrates a hypothetical experimental situation in which different fractions, attributable to different analyte species, are chromatographically well resolved (in time) upon introduction into a mass spectrometer. Curves A10 and A12 represent a hypothetical concentration of each respective analyte at various times, where concentration is indicated as a percentage on a relative intensity (R.I.) scale and time is plotted along the abscissa as retention time. The curves A10 and A12 may be readily determined from measurements of total ion current input into a mass spectrometer. A threshold intercity level A8 of the total ion element is set below which only MS1 data is acquired. As a first analyte—detected as peak A10—elutes, the total ion current intensity crosses the threshold A8 at time t1. When this occurs, an on-board processor or other controller of the mass spectrometer may initiate one or more MS/MS spectra to be acquired. Subsequently, the leading edge of another elution peak A12 is detected. When the total ion current once again breaches the threshold intensity A8 at time t3, one or more additional MS/MS scans are initiated. Generally, the peaks A10 and A12 will correspond to the elution of different analytes and, thus, different precursor ions are selected for fragmentation during the elution of the first analyte (between time t1 and time t2) than are selected during the elution of the second analyte (between time t3 and time t4). Because the different precursor ions will, in general, comprise different m/z ratios and different charge states, the experimental conditions inquired to produce optimum fragmentation may differ between the two different elution periods.

In a more-complex mixture of analytes, there may be components whose elution peaks completely overlap, as illustrated in the graph of ion current intensity versus retention time in FIG. 1B. In this example elution peak A11 represents the ion current attributable to a precursor ion generated from a first analyte and the elution peak A13 represents the ion current attributable to a different precursor ion generated from a second analyte, where the masses and/or charge states of these different precursor ions are different from one another. In the hypothetical situation shown in FIG. 1B, there is almost perfect overlap of the elution of the compounds that give rise to the different ions, with the mass spectral intensity of the first precursor ion always being greater than that of the second precursor ion during the course of the co-elution. At any time daring the co-elution of the two analytes—for example, between time t6 and time t7—a mass spectrum of all precursor ions may appear as is hypothetical shown in FIG. 1C, with the set of lines indicated by envelope 78 arising from ionization of the first analyte and the set of lines indicated by envelope 76 arising from ionization of the second analyte. Under these conditions, automated mass spectral analysis must be able to not only distinguish between different precursor ions associated with the different respective analytes but must also be able to adjust the collision energy that is imparted to the different precursor ions during mass spectral analysis such that each ion is optimally fragmented. Indeed, as noted below, proper scaling of applied collision energy is important even when analytes are not co-eluting. The correct scaling is of particular importance, regardless of relative elution timing, when the characteristics of multiple analytes (e.g., MW and/or z) are significantly different.

One common method of causing ion fragmentation in MS-MS analyses is collision induced dissociation (CID), in which a population of analyte precursor ions are accelerated into target neutral gas molecules such as nitrogen ($N_2$) or argon (Ar), thereby imparting internal vibrational energy to precursor ions which can lead to bond breakage and dissociation. The fragment ions are analyzed so as to provide useful information regarding the structure of the precursor ion. The term "collision induced dissociation" includes techniques in which energy is imparted to precursor ions by means of a resonance excitation process, which may be referred to as RE-CID techniques. Such resonant-excitation methods include application of an auxiliary alternating current voltage (AC) to trapping electrodes in addition to a main RF trapping voltage. This auxiliary voltage typically has relatively low amplitude (on the order of 1 Volt (V)) and duration on the order of tens of milliseconds. The frequency of this auxiliary voltage is chosen to match an ion's frequency of motion, which in turn is determined by the main trapping field amplitude, frequency and the ion's mass-to-charge ratio (m/z). As a consequence of the ion's motion being in resonance with the applied voltage, the ion's energy increases, and its amplitude of motion grows.

FIG. 2 schematically illustrates another method of collision induced dissociation, which is sometimes referred to as higher-energy collisional dissociation (HCD). In the HCD method selected ions are either temporarily stored in or caused to pass through a multipole ion storage device 52, which may, for instance, comprise a multipole ion trap. At a certain time, an electrical potential on a gate electrode assembly 54 is changed so as to accelerate the selected precursor ions 6 out of the ion storage device and into a collision cell 56 containing molecules 8 of an inert target gas. The ions are accelerated so as to collide with the target molecules at a kinetic energy that is determined by the difference in the potential offsets between the collision cell and the storage device.

It is highly desirable, when using either HCD or RE-CID to generate fragment ions in MS/MS experiments, to set instrumentation so as to impart a correct amount of collision energy to selected precursor ions. For HCD, the collision energy (CE) is set by setting the potential difference through which ions are accelerated into the HCD cell. There they collide one or more times with the resident gas until they exceed a vibrational energy threshold for bond cleavage to produce dissociation product ions. Product ions may retain enough kinetic energy that further collisions result in serial dissociation events. The optimal collision energy varies according to the properties of the selected precursor ions. Setting the HCD collision energy too high can result in such serial dissociation events, producing an abundance of small, non-specific product ion species. Conversely, setting this potential too low will result in a paucity of informative product ions ail together since the mass spectral signature of at least some fragment ions may be weak or absent. In either case, one would not be able to gain sufficient structural information about the precursor ion from the product ion spectrum to provide for identification or structural or sequence) elucidation. Analytes of different size, structure, and charge capacity dissociate to a different degree at any given CE. Therefore, using just a single collision energy setting for all precursor ions dining the course of an automated mass spectral analysis experiment presents the risk that the degree of fragmentation will be sub-optimal or non-acceptable for some ions. Nonetheless, mass spectral analysis programs are often performed on samples or sample fractions having a reduced chemical diversity for a variety of reasons (e.g., ionization, chromatography, fragmentation, etc). Reducing the chemical diversity increases the likelihood of setting an appropriate collision energy through tuning collision energy on similar analytes.

Although resonant excitation CID (RE-CID) and HCD produce similar mass spectra from the same charge from the same protein, the exact collision energy optimum needed to produce the maximum amount of structural information can vary greatly. In the case of RE-CID, since the applied auxiliary frequency is at the same fundamental frequency as the motion of a precursor ion, the internal energy of the precursor ion is increased to point that a minimum energy of dissociation is reached and product ions are produced. As the applied energy is increased the degree of fragmentation reaches a maximum and plateaus as the precursor ion is depleted. If the applied fragmentation energy is further increased there is typically no change in the relative abundances of the various product ions. Instead, the relative abundances of product ions remain approximately constant as fragmentation energy is increased beyond the onset of the plateau region and little to no additional relevant structural information is obtained front this process.

In contrast, in the case of HCD fragmentation, the collisional activation process is a function only of the electrical potential difference between the HCD cell and an adjacent ion optical element. Therefore, any product ions formed in the HCD cell can undergo further fragmentation depending on their excess internal energy. Since the HCD process involves the use of nitrogen as a collision gas versus that of helium typically used in RE-CID experiments, higher energies and more structural information can be gained from the HCD process, provided that a near-optimal collision energy is applied. In the RE-CID process, increase of applied collision energyy beyond its optimal value decreases the amount of remaining precursor ion but does not significantly change the relative amounts of fragment ions. In HCD fragmentation, increase of applied collision energy beyond its optimal value often causes further fragmentation of fragment ions.

FIG. 3A shows a general comparison between the effect of increasing energy on the number of identifiable protein fragment ions generated by HCD fragmentation (curve 151) and the effect of increasing energy on the number of such identifiable ions generated by RE-CID fragmentation (curve 152). Curve illustrates the effect of changing applied resonance energy on the fragmentation of a precursor ion derived from the protein myoglobin. In this example, when the collision energy is increased beyond 25% RCE, the amount of structural information remains relatively constant. In contrast, when the HCD process is employed (curve 151), there is a sharply defined maximum in structural information content obtained for an HCD energy of approximately 28% RCE. At collision energies either less than or exceeding this optimal RCE setting, there can be a dramatic decrease in the quality of structural information obtained from an HCD experiment.

The effect of changing applied HCD fragmentation energy is well illustrated in the fragmentation of the +8 charge state precursor ion from the protein ubiquitin, as illustrated in the product ion mass spectra of FIGS. 3B-3D. FIG. 3B shows a limited number of fragment ions produced from fragmentation of this ion using a sub-optimal RCE setting of 25%. In many experimental situations, such limited fragmentation will not allow for the proper identification of the protein from either searching a standard tandem mass spectrometry library or using sequence information front available databases. However, when the RCE setting is changed to 30%, the HCD fragmentation of the same precursor ion is optimal and the resulting product ion mass spectrum (FIG. 3C) exhibits a rich array of fragments of various charge states that enable the protein to be identified using any one of several approaches. Finally, as shown in FIG. 3D, a further increase of the RCE setting to 40% causes an over-fragmentation situation in which the majority of the generated product ions are singly charged low mass fragments that are more indicative of the amino acid composition of the protein than the actual protein sequence itself. Therefore it is highly desirable that collision energies for the HCD fragmentation of unknown proteins and complex mixtures be adjusted in real time so as to maximize the information content available.

U.S. Pat. No. 6,124,591, in the name of inventors Schwartz et al., describes a method of generating product ions by RE-CID in a quadrupole ion trap, in which the amplitude of the applied resonance excitation voltage is substantially linearly related to precursor-ion m/z ratio. The techniques described in U.S. Pat. No. 6,124,591 attempt to normalize out the primary variations in optimal resonance excitation voltage amplitude for differing ions, and also the variations due to instrumental differences. Schwartz et al. further found that the effects of the contributions of varying structures, charge states and stability on the determination of applied collision energy are secondary in nature and that these secondary effects may be modeled by simple correction factors.

According to the teaching of Schwartz et al., the substantially linear relationship between optimal applied CE and m/z is simply and rapidly calibrated on a per instrument basis. The accompanying FIG. 4A schematically illustrates the principles of generation and use of the calibration curve. Initially, a calibration curve for a particular mass spectral instrument is generated by fitting a linear relationship to calibration data in which a particular percentage of reduction (such as 90% reduction) of precursor-ion intensity is observed. This linear relationship is illustrated as line 22 in FIG. 4A. Schwartz et al. found that a two-point calibration is sufficient to characterize the linear relationship and that, more simply, a one-point calibration may be used if an intercept for the line is fixed at a certain value or at zero. In a typical calibration, the intercept of the calibration line 22 is assumed to be at the origin, as shown in FIG. 4A, and a one-point calibration includes determination or calculation of the applied collision energy at a reference point 29 at a specified reference mass-to-charge ratio (m/z)0. Typically, the reference point is at m/z=500 Da and the reference collision energy value measured at or extrapolated to 500 Da during calibration may be denoted as $CE_{500}$.

Once an instrumental calibration has been determined, subsequent operation of the mass spectrometer does not generally employ the full CE values suggested by the line 22 but, instead, employs a relative collision energy (RCE) value, expressed as a percentage of the CE value of the value given by line 22 at any given m/z. For example, lines 24, 26 and 28 shown in FIG. 4A represent RCE values of 75%, 50% and 25%, respectively. Subsequently, a user may simply specify a desired value of RCE. The secondary effects of precursor-ion charge state, z, on optimal applied CE are accounted for by simple scalar charge correction factors, f(z). These general relationships, initially determined for RE-CID fragmentation base been also found to be valid for HCD fragmentation. With these simplifications, the absolute collision energy, $CE_{actual}$, which is expressed in electron volts for HCD fragmentation, that is applied to each precursor is then automatically set according to the following equation:

$$CE_{actual} = RCE \times CE_{500} \times \left[\left(\frac{m}{z}\right) / 500\right] \times f(z) \quad \text{Eq. 1}$$

where $CE_{actual}$ is the appled collision energy, generally expressed in electron-Volts (eV), RCE is Relative Collision Energy, a percentage value that is generally user-defined for each experiment and f(z) is a charge correction factor. Table 1 in FIG. 4B lists the accepted charge correction factors. Note that both the numerator and denominator of the fraction in brackets are expressed in units of Daltons, Da (or, more accurately, thomsons, Th). Although this equation is typically sufficient to fine tune the absolute CE applied to samples within a narrow range of precursor ion characteristics, it should be noted that, as f(z) yields a fixed value for z≥5, the collision energies are usually too high for heavier molecules with higher charge states (such as proteins and polypeptides), leading to an over-fragmentation of those species.

Recently, mass spectral analysis of intact proteins and polypeptides has gained significant popularity. For such applications, analytes within a sample can range dramatically in size, structure, and charge capacity, and therefore require very different collision energies to achieve the same extent of dissociation. It has been found that the equation above does not sufficiently normalize collision energy for all precursors in samples of polypeptides or intact proteins, even if the range of charge factors is extended and extrapolated for charge states above +5. Therefore, a revised model is required for these particular analytes.

SUMMARY

The present teachings are directed to establishing a new dissociation parameter that will be used to determine the HCD (collision cell type CID) collision energy (CE) needed to achieve a desired extent of dissociation for a given analyte precursor ion. This selection is based solely on the molecular weight (MW), and charge state, (z), of the analyte precursor ion. To do this, the inventors have devised two different metrics that may be used as a measure of the "extent of dissociation", D, and that replace the previously used Relative Collision Energy and Normalized Collision Energy parameters. The two new metrics are relative precursor decay ($D_p$) and spectral Entropy ($D_D$), although other metrics can be imagined that describe extent of dissociation in the future. The inventors have further developed predictive models of the collision energy values required to achieve a range of values for each such metric. Each model is a simple smooth function of only MW and z of the precursor ion. Coupled with a real-time spectral deconvolution algorithm that is capable of determining molecular weights of analyte molecules, these new teachings will enable control over the extent of dissociation through automated, real-time selection of collision energy in a precursor-dependent manner. Through these novel collision-energy determination methods, the inventors eliminate the necessity for users to "tune" or otherwise "optimize" collision energy for different compounds or applications, as a single "extent of dissociation" parameter setting will apply across all sampled MW and z. Such a capability is advantageous for intact protein analyses, where precursors may cover a wide range of physical characteristics in a single sample. Existing methods are tailored for a limited range of analyte characteristics (such as characteristics for simple peptides) and do not adequately address the complexity of analyses of intact protein and polypeptides.

BRIEF DESCRIPTION OF DRAWINGS

To further clarify the above and other advantages and features of the present disclosure, a more particular description of the disclosure will be rendered by reference to specific embodiments thereof, which are illustrated in the appended drawings. It is appreciated that these drawings depict only illustrated embodiments of the disclosure and are therefore not to be considered limiting of its scope. The disclosure will be described and explained with additional specificity and detail through the use of the accompanying drawings in which:

FIG. 4A is a graph showing a relation between imparted collision energy and precursor-ion mass-to-charge ratio according to a known "normalized collision energy" operational technique;

FIG. 3C is a schematic illustration of hypothetical multiple interleaved mass spectral peaks of two simultaneously eluting protein or polypeptide analyses;

FIG. 6B is a table of parameters that may be used to calculate, in accordance with a model of the present teachings, a collision energy that should be experimentally provided to yield various desired precursor-ion survival percentages, $D_p$, tabulated at various selected values of $D_p$.

FIG. 8B is a table of parameters that may be used to calculate, in accordance with another model of the present teachings, a collision energy that should be experimentally provided to yield assemblages of product ions that are distributed according to a product-ion entropy parameter, $D_E$, tabulated at various selected values of $D_E$.

FIG. 11 is a tabular version of the charge state sealing factors that are graphically depleted in FIG. 10;

MODES FOR CARRYING OUT THE INVENTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the claims. The particular features and advantages of the invention will become more apparent with reference to the appended FIGS. 1-14, when taken in conjunction with the following discussion.

Figure 5A:
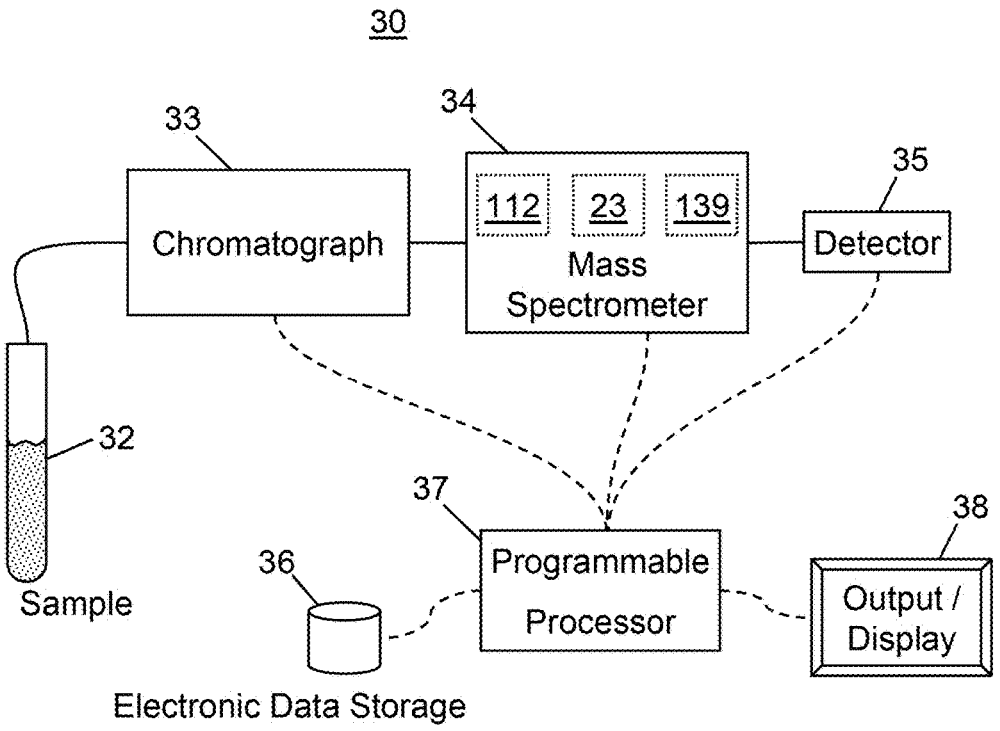
FIG. 5A (Prior Art)
FIG. 5A is a schematic diagram of a system for generating and automatically analyzing chromatography/mass spectrometry spectra in accordance with the present teachings.

FIG. 5A is a schematic example of a general system 30 for generating and automatically analyzing chromatography/mass spectrometry spectra as may be employed in conjunction with the methods of the present teachings. A chromatograph 33, such as a liquid chromatograph, high-performance liquid chromatograph or ultra high performance liquid chromatograph receives a sample 32 of an analyte mixture and at least partially separates the analyte mixture into individual chemical components, in accordance with well-known chromatographic principles. The resulting at least partially separated chemical components are transferred to a mass spectrometer 34 at different respective times for mass analysis. As each chemical component is received by the mass spectrometer, it is ionized by an ionization source 112 of the mass spectrometer. The ionization source may produce a plurality of ions comprising a plurality of ion species (i.e., a plurality of precursor ion species) comprising differing charges or masses from each chemical component. Thus, a plurality of ion species of differing respective mass-to-charge ratios may be produced for each chemical component, each such component elating from the chromatograph at its own characteristic time. These various ion species are analyzed—generally by spatial or temporal separation—by a mass analyzer 139 of the mass spectrometer and detected by a detector 35. As a result of this process, the ion species may be appropriately identified according to their various mass-to-charge (m/z) ratios. As illustrated in FIG. 5A, the mass spectrometer comprises a reaction cell 23 to fragment or cause other reactions of the precursor ions, thereby generating a plurality of product ions comprising a plurality of product ion species.

Still referring to FIG. 5A, a programmable processor 37 is electronically coupled to the detector of the mass spectrometer and receives the data produced by the detector during chromatographic/mass spectrometric analysis of the sample(s). The programmable processor may comprise a separate stand-alone computer or may simply comprise a circuit board or any other programmable logic device operated by either firmware or software. Optionally, the programmable processor may also be electronically coupled to the chromatograph and/or the mass spectrometer in order to transmit electronic control signals to one or the other of these instruments so as to control their operation. The nature of such control signals may possibly be determined in response to the data transmitted from the detector to the programmable processor or to the analysis of that data as performed by a method in accordance with the present teachings. The programmable processor may also be electronically coupled to a display or other output 38, for direct output of data or data analysis results to a user, or to electronic data storage 36. The programmable processor shown in FIG. 5A is generally operable to: receive a precursor ion chromatography/mass spectrometry spectrum and a product ion chromatography/mass spectrometry spectrum from the chromatography/mass spectrometry apparatus and to automatically per form the various instrument control, data analysis, data retrieval and data storage operations in accordance with the various methods discussed below.

Figure 5B:
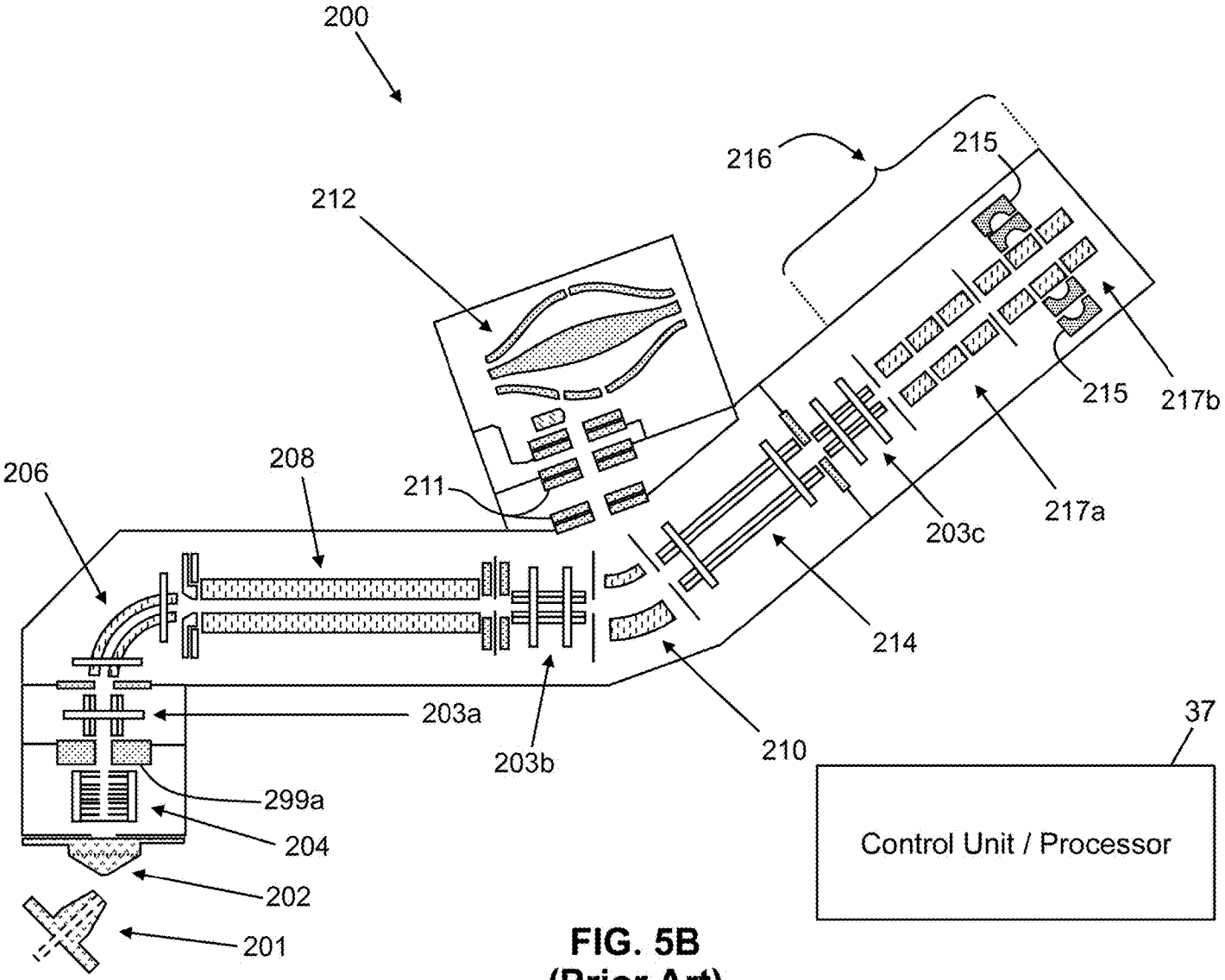
FIG. 5B (Prior Art)
FIG. 5B is a schematic representation of an exemplary mass spectrometer suitable for employment in conjunction with methods according to the present teachings, the mass spectrometer comprising a hybrid system comprising a quadrapole mass filter, a dual-pressure quadrupole ion trap mass analyzer and an electrostatic trap mass analyzer.

FIG. 5B is a schematic depiction of an specific exemplary mass spectrometer 200 which may be utilized to perform methods in accordance with the present teachings. The mass spectrometer illustrated in FIG. 5B is a hybrid mass spectrometer, comprising more than one type of mass analyzer. Specifically, the mass spectrometer 200 includes an ion trap mass analyzer 216 as well as an Orbitrap™ 212, which is a type of electrostatic trap mass analyzer. The Orbitrap™ mass analyzer 212 employs image charge detection, in which ions are detected indirectly by detection of an image current induced on an electrode by the motion of ions within an ion trap. Various analysis methods in accordance with the present teachings employ multiple mass analysis data acquisitions. Therefore, a hybrid mass spectrometer system can be advantageously employed to improve duty cycles by using two or more analyzers simultaneously. However, a hybrid system of the type shown in FIG. 5B is not required and methods in accordance with the present teachings may be employed on any mass analyzes system that is capable of tandem mass spectrometry and that employs collision induced dissociation. Suitable types of mass analyzers and mass spectrometers include, without limitation, triple-quadrupole mass spectrometers, quadrupole-time-of-flight (q-TOF) mass spectrometers and quadrupole-Orbitrap™ mass spectrometers.

In operation of the mass spectrometer 200, an electrospay ion source 201 provides ions of a sample to be analyzed to an aperture of a skimmer 202, at which the ions enter into a first vacuum chamber. After entry, the ions are captured and focused into a light beam by a stacked-ring ion guide 204. A first ion optical transfer component 203*a* transfers the beam into downstream high-vacuum regions of the mass spectrometer. Most remaining neutral molecules and undesirable high-velocity ion clusters, such as solvated ions, are separated from the ion beam by a curved beam guide 206. The neutral molecules and ion clusters follow a straight-line path whereas the ions of interest are caused to bend around a ninety-degree turn by a drag field, thereby producing the separation.

A quadrupole mass filter 208 of the mass spectrometer 200 is used in its conventional sense as a tunable mass filter so as to pass ions only within a selected narrow m/z range. A subsequent ion optical transfer component 203*b* delivers the filtered ions to a curved quadrupole ion trap ("C-trap") component 210. The C-trap 210 is able to transfer ions along a pathway between the quadrupole mass filter 208 and the ion trap mass analyzer 216. The C-trap 210 also has the capability to temporarily collect and store a population of ions and then deliver the ions, as a pulse or packet, into the Orbitrap™ mass analyzer 212. The transfer of packets of ions is controlled by the application of electrical potential differences between the C-trap 210 and a set of injection electrodes 211 disposed between the C-trap 210 and the Orbitrap™ mass analyzer 212. The curvature of the C-trap is designed such that the population of ions is spatially focused so as to match the angular acceptance of an entrance aperture of the Orbitrap™ mass analyzer 212.

Multipole ion guide 214 and optical transfer component 203*b* serve to guide ions between the C-trap 210 and the ion trap mass analyzer 216. The multipole ion guide 214 provides temporary ion storage capability such that ions produced in a first processing step of an analysis method can be later retrieved for processing in a subsequent step. The multipole ion guide 214 can also serve as a fragmentation cell. Various gale electrodes along the pathway between the C-trap 210 and the ion trap mass analyzer 216 are controllable such that ions may be transferred in either direction, depending upon the sequence of ion processing steps required in my particular analysis method.

The ion trap mass analyzer 216 is a dual-pressure quadrupole linear ion trap (i.e., a two-dimensional trap) comprising a high-pressure linear trap cell 217*a* and a low-pressure linear trap cell 217*b,* the two cells being positioned adjacent to one another separated by a plate lens having a small aperture that permits ion transfer between the two cells and that presents a pumping restriction and allows different pressures to be maintained in the two traps. The environment of the high-pressure cell 217*a* favors ion cooling, ion fragmentation by either collision-induced dissociation or electron transfer dissociation or ion-ion reactions such as proton-transfer reactions. The environment of the low-pressure cell 217*b* favors analytical scanning with high resolving power and mass accuracy. The low-pressure ceil includes a dual-dynode ion detector 215.

As illustrated in FIG. 5B. the mass spectrometer 200 further includes a control unit 37 that can be linked to various components of the system 200 through electronic linkages. As depicted in the previously discussed FIG. 5A, the control unit 37 may be linked to one or more additional "front end" apparatuses that supply sample to the mass spectrometer 200 and that may perform various sample preparation and/or fractionation steps prior to supplying sample material to the mass spectrometer. For example, as part of the operation of controlling a liquid chromatograph, the controller 37 may controls the overall flow of fluids within the liquid chromatograph including the application of various reagents or mobile phases to various samples. The control unit 37 can also serve as a data processing unit to, for example, process data (for example, in accordance with the present teachings) from the mass spectrometer 200 or to forward the data to external server(s) for processing and storage (the external servers not shown).

Data Acquisition for Model Development

Dissociation mass spectrometry data (MS/MS tandem mass spectrometry data) were collected on the following eleven protein standards: Ubiquitin (~8 kDa), Cytochrome c (~12 kDa), Lysozyme (~14 kDa), RNAse A (~14 kDa), Myoglobin (~17 kDa), Trypsin inhibitor (~19 kDa), Rituximab LC (~25 kDa), Carbonic anhydrase (~29 kDa), GAPOH (~35 kDa), Enolase (~46 kDa), and Bovine serum albumin (~66 kDa). Sample introduction was by direct infusion and samples were ionized by electrospray ionization. These proteins were chosen for building the model due to their well understood fragmentation patterns and performance as typical top-down protein standards. Approximately 10 charge states of each protein were selected for MS/MS analysis by HCD dissociation. In these experiments, the absolute collision energy, CE, was varied according to 1-electron-volt (eV) steps from 5 to 50 eV in absolute collision energy for each precursor ion. From these decay curves logistic regression plots are obtained for each charge state analyzed. The metric values $D_p$ and $D_E$ were calculated for each spectrum, and these values were then used to develop predictive models of the CEs required to achieve a range of D values as a function of precursor MW and z.

Precursor Decay Models

Approach 1

Figure 6A:
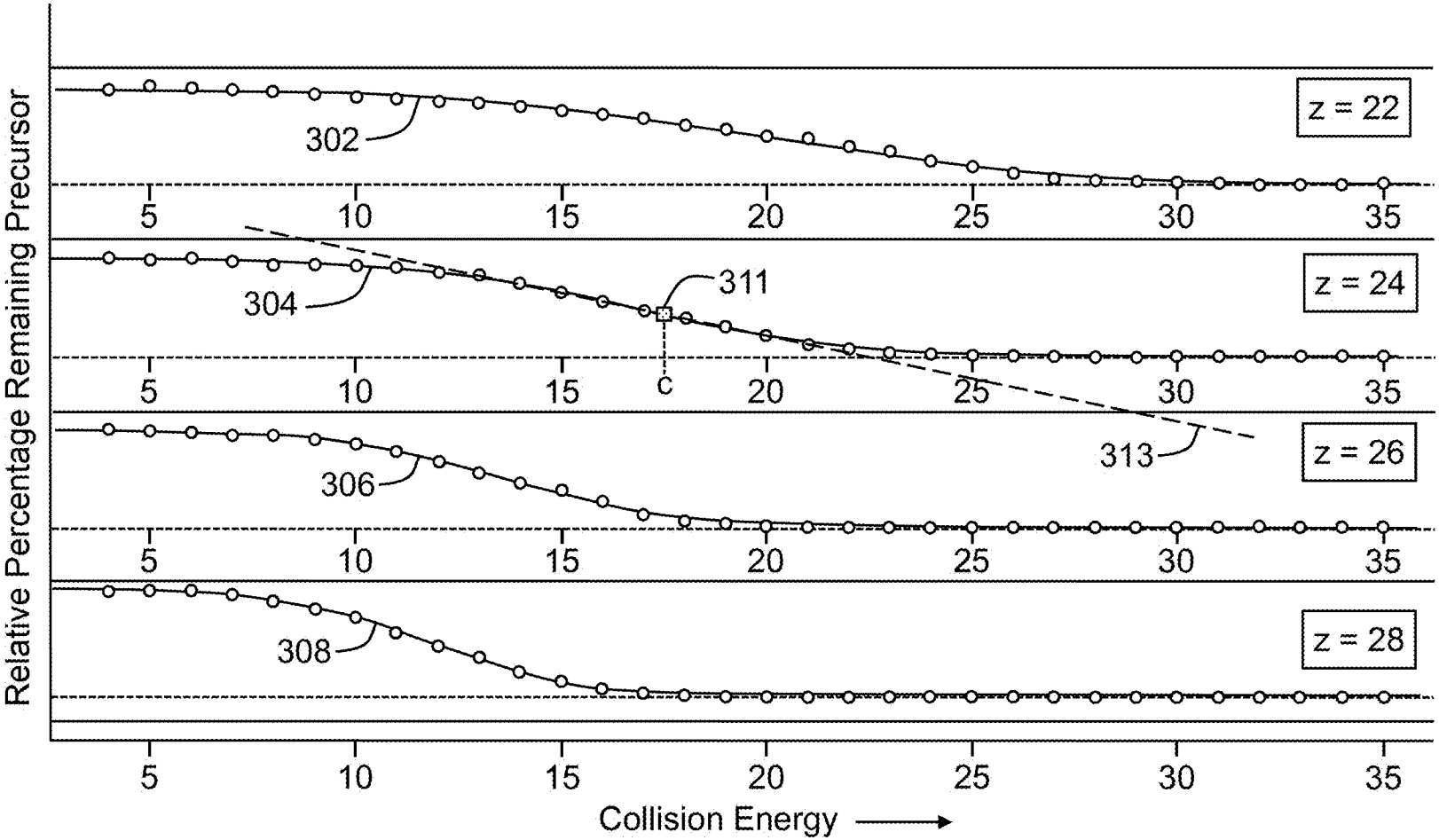
FIG. 6A is a set of graphical plots of the percentage of various precursor ion species remaining after fragmentation as a function of applied collision energy and fitting of the data by logistic regression plots, where the precursor ion species are the +22, +24, +26, and +28 charge states of carbonic anhydrase, of approximate molecular weight of 29 KDalton.

For each protein standard, at each precursor-ion charge state z, the remaining precursor-ion intensity relative to the measured total ion current, $D_p$, was calculated at each absolute collision energy (CE). The variation of $D_p$ with CE follows a standard decay curve as shown in FIG. 6A, where decay curves 302, 304, 306 and 308 represent precursor-ion decay curves for the +22, +24, +26, and +28 charge states of carbonic anhydrase, respectively. The inventors model the variation by a logistic regression $$CE=c+(1/k)[\ln(1/D_p)-1] \quad \text{Eq. 2}$$

where the parameter, c, represents the CE at 50% relative precursor remaining and the parameter, k, is the -slope at c. Curve 304 of FIG. 6A, which corresponds to z+24, includes additional marking to further depict the calculation of the parameters c and k for this particular charge state. Specifically, point 311 is the point at which curve 304 crosses the 50% threshold and, accordingly, the parameter, c, is located at approximately 17.6 eV. Further, line 313 is the tangent to curve 304 at point 311. Accordingly, the parameter k is determined as the slope of this tangent line. Computationally, the values of c and k are obtained by a least squares fit to the computed relative remaining intensity. The best fitting parameters depend on the molecular weight, MW, of the protein standard as well as the charge state z at which the protein is fragmented. The parameters c and k can be modeled as simple products of powers of MW and z. Least squares fitting is again used to arrive at the best fit powers for c and k as follows.

$$c=0.0018\times MW^{1.6}\times z^{-2.2} \quad \text{Eq. 3}$$

$$k=0.00025\times MW^{1.7}\times z^{1.9} \quad \text{Eq. 4}$$

Using Approach 1, once molecular weight, MW, and charge, z, have been determined (as described below), the values of the c and k parameters may be determined from Eqs. 3 and 4. Then, for any desired residual precursor-ion percentage, $D_p$, the calculated c and k values may be used to calculate the required collision energy, CE, that must be applied, through Eq. 2.

Approach 2

The second approach diverges from the above-described "Approach 1" after the step of modeling of each decay curve by a logistic regression of Eq. 2. Instead of expressing the parameter, c, as a single function of the two variables MW and z and likewise expressing the parameter, k, as another single function of the same two independent variables, the second approach employs a more stepwise strategy. In this approach, a target percentage of remaining relative precursor intensity, $D_p$, is first specified. Then, Eq. 1 is employed (using the c and k values determined from the various decay curves), to compile a table of all CE, MW and z values that give rise, in combination, to the target precursor-ion percentage, $D_p$. Then, least squares fitting is used to obtain the functional form of CE at this target, as a product of powers of MW and z. In this fashion, for each $D_p$ of interest, a more tailored model of the appropriate CE is obtained. In such a tailored model, the required collision energy (CE) for achieving a certain percentage, $D_p$, of precursor-ion survival may be calculated from a set of equations of the form:

$$CE(D_p)=a1\times MW^{a2}\times z^{a3} \quad \text{Eq. 5}$$

where a1, a2 and a3 are parameters that may be pre-calculated and tabulated for each of various $D_p$ values of interest. A table of values of these parameters for various selected values of $D_p$ is provided as Table 2 that is provided in the accompanying FIG. 6B.

Entropy Model

Figure 7A:
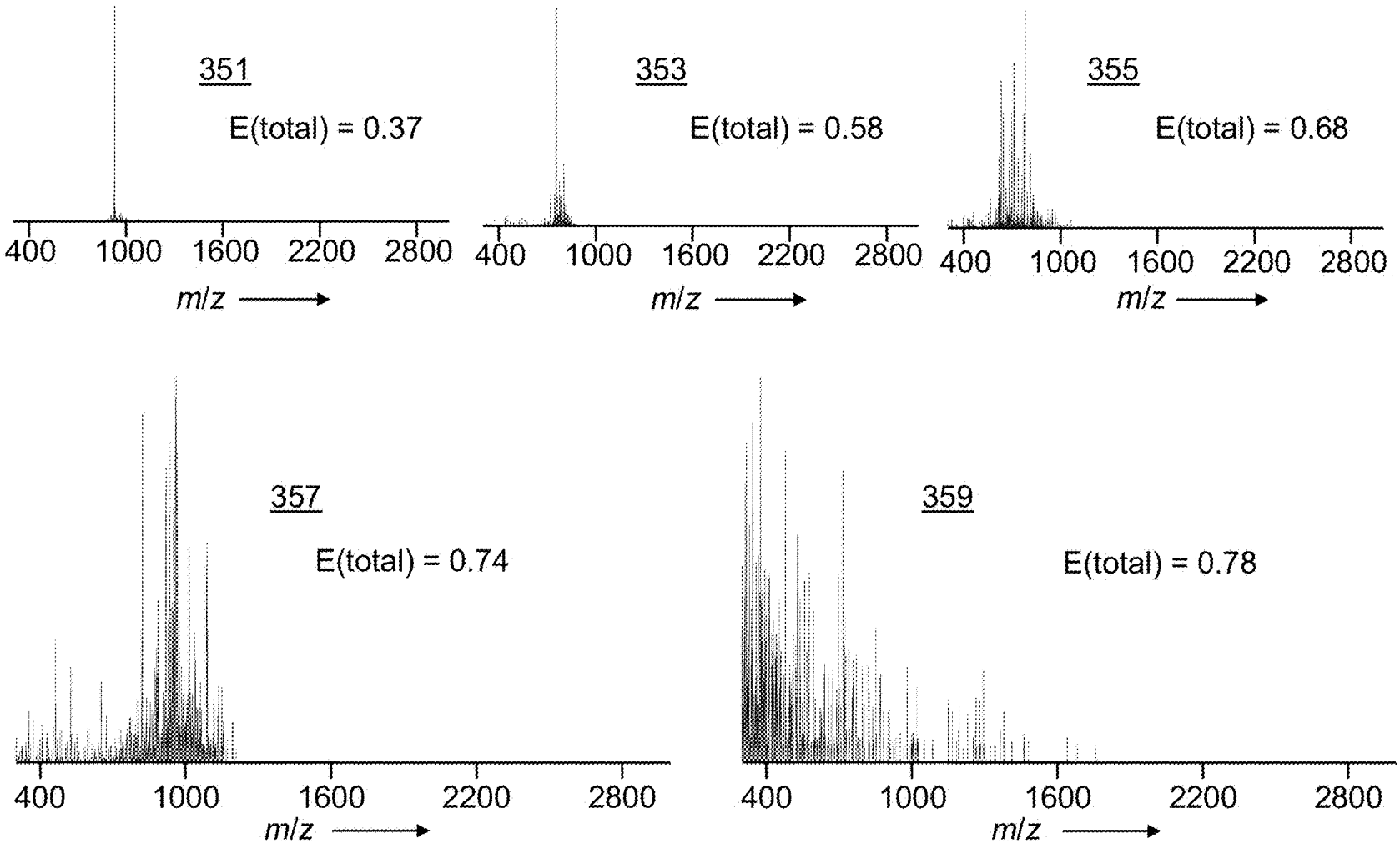
FIG. 7A is a set of five representative product-ion mass spectra of varying extents of collisional induced dissociation, showing the variation of "total mass spectral entropy" values, as calculated in accordance with the present teachings.
Figure 7B:
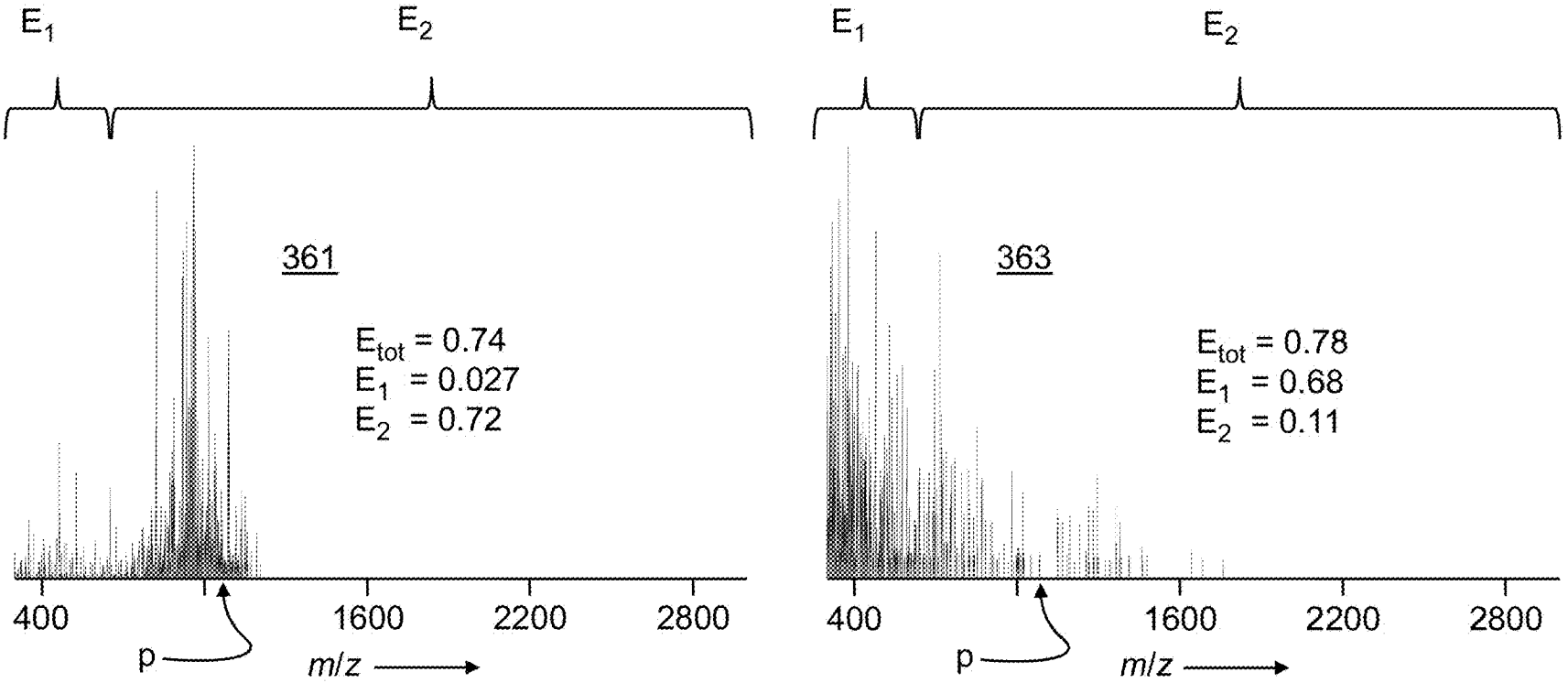
FIG. 7B is an example of division of each of two product-ion mass spectra into two regions and the determination of a first mass spectral entropy, $E_1$, associated with each first region and a second mass spectral entropy, $E_2$, associated with each second region and comparisons between $E_1$, $E_2$ and total mass spectral entropy, $E_{tot}$.

Another metric of extent of dissociation, total spectral Entropy, is defined for a centroided product-ion mass spectrum, as follows:

$$E_{total}=\Sigma_i p_i \ln(p_i) \quad \text{Eq. 6}$$

in which $p_i$ is the centroid intensity (or area) for a mass spectral peak (in m/z) of index i normalized by the total intensity (or area) of all such peaks, or else by total ion current, TIC. The summation is over all centroids in the spectrum (all i). It is found that the calculated values for total spectral Entropy of HCD product ion spectra, as defined above, closely reflect the extent of dissociation observed in the data up to a value of $E_{total}$ of approximately 0.7, at which point the location of the ion current becomes important to consider (FIG. 7A). to enhance the ability to distinguish (or resolve) the "ideally dissociated" to the over fragmented range (high total spectrum Entropy), the total entropy is divided into a first partial entropy ($E_1$) and a second partial entropy ($E_2$), where $E_1$ represents the entropy of the region of the MS/MS spectrum from the smallest-value m/z up to one-half of the m/z of the precursor ion, and $E_2$ represents the entropy of the region of the spectrum from one-half of the m/z of the precursor to the last m/z (FIG. 7B). Therefore, using Eq. 6 to calculate $E_1$, only $p_i$ values for m/z peak centroids within $E_1$ region are used, and likewise, using Eq. 6 to calculate $E_2$, only $p_i$ values for m/z peak centroids within the $E_2$ region are summed. The denominator in the calculations for the $p_i$ in the calculations of both $E_1$ and $E_2$ is again the total ion current of the spectrum (both $E_1$ and $E_2$ regions).

Figure 8A:
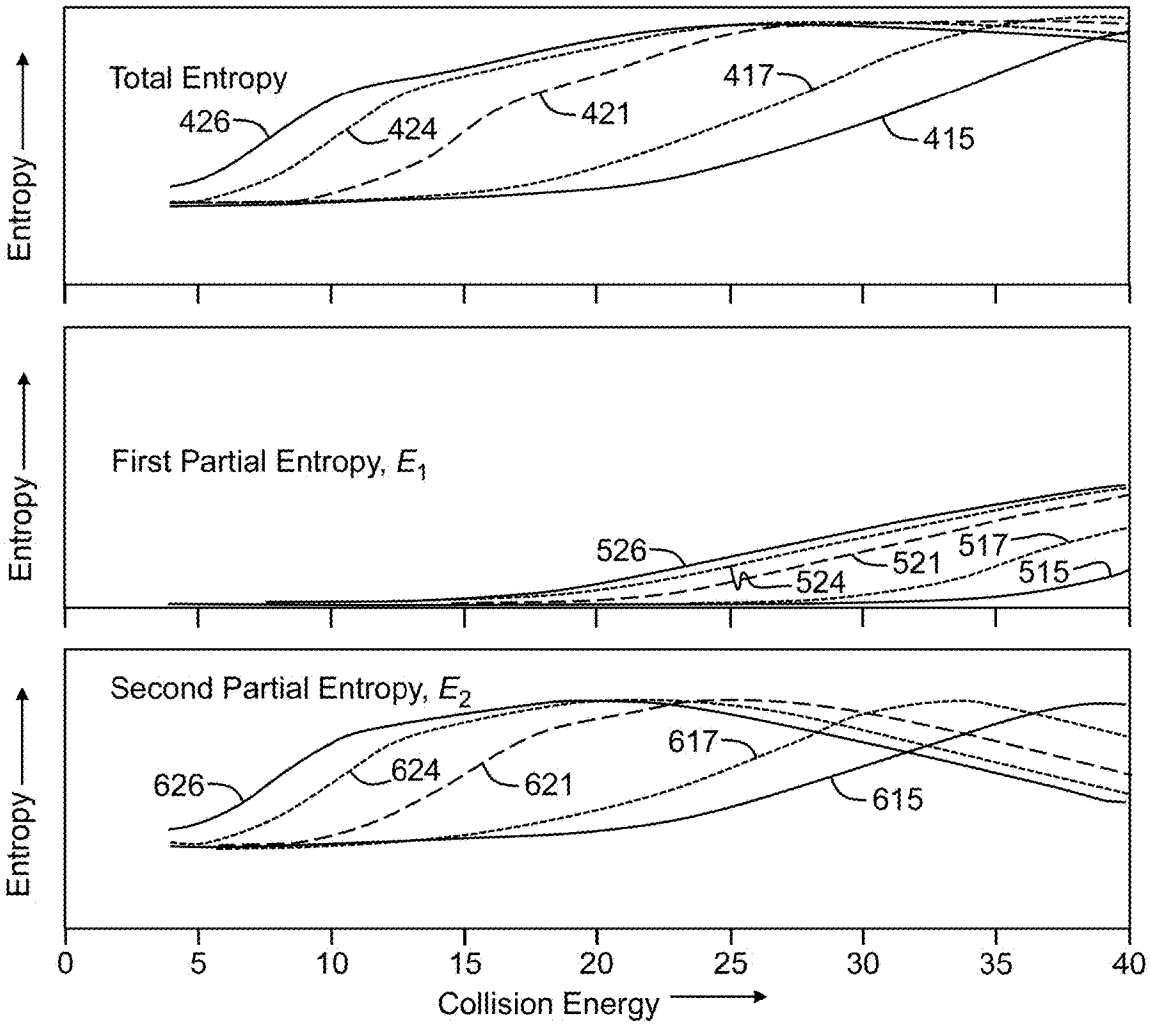
FIG. 8A is a set of plots of total, mass spectral entropy (top panel), $E_1$ (middle panel), and $E_2$ (bottom panel), as calculated from product-ion spectra in accordance with the present teachings, as a function of collision energy imparted to the indicated precursor-ion charge states of myoglobin (~17 kDalton).

The calculated $E_{total}$, $E_1$, and $E_2$ for selected precursor-ion charge states of myoglobin, an approximately 17 kDa protein from the model data set, are shown in FIG. 8A. Curves 426, 526 and 626 respectively represent the calculated $E_{total}$, $E_1$ and $E_2$ for the h+26 charge state of myoglobin as a function of applied collision energy. Likewise, curves 424, 524 and 624 respectively represent the calculated $E_{total}$, $E_1$ and $E_2$ for the +24 charge state of myoglobin as a function of applied collision energy. Likewise, curves 421, 521 and 621 respectively represent the calculated $E_{total}$, $E_1$ and $E_2$ for the +21 charge state of myoglobin as a function of applied collision energy. Likewise, curves 417, 517 and 617 respectively represent the calculated $E_{total}$, $E_1$ and $E_2$ for the +17 charge state of myoglobin as a function of applied collision energy. Finally, curves 415, 515 and 615 respectively represent the calculated $E_{total}$, $E_1$ and $E_2$ for the +15 charge state of myoglobin as a function of applied collision energy.

Taking all protein plots into consideration, it is observed that: (a) the $E_1$ values are monotonically increasing over the range of CE of interest; (b) the $E_1$ curves are much smoother than those of $E_2$ and (c) all the $E_1$ curves can be well modeled by logistic regression. The drawback to using $E_1$ data along is that the curves are relatively featureless and thus it's difficult to standardize the different $E_1$ values. However, advantage is taken of the fact that each $E_2$ curve almost always contains a well-defined maximum, which serves to define a reference CE for every charge state of each protein standard. As such, the inventors have modeled the relationship between MW, precursor z, and the value of CE at the maximum in the $E_2$ curve which resulted in the following Eq. 7:

$$CE^{E2max}=0.1\times MW^{0.93}\times z^{-1.5} \quad \text{Eq. 7}$$

Now applying this set of reference CE values to eh $E_1$ curves, it is possible to determine the $E_1$ value that corresponds to the $E_2$ maximum for each charge state of each protein standard. Further, using a logistic fit on each $E_1$ curve, it is possible to define, for each z of each standard, the CE that gives rise to any desired fractional value of the reference entropy. This fractional reference entropy becomes the new parameter $D_E$. Specifically, the parameter $D_E$ is defined for any particular z, as $$D_E=E_1/E_1^{E2max} \quad \text{Eq. 8}$$

where $E_1^{E2max}$ is the value of the first partial entropy, $E_1$, at the value of the collision energy, $CE^{E2max}$, that is associated with the maximum in the second partial entropy, $E_2$. The collection of CE values for any particular fractional entropy value can be fitted to a power functional form analogous to Eq. 7, written in the general form:

$$CE(D_E)=b1\times MW^{b2}\times z^{b3} \quad \text{Eq. 9}$$

where b1, b2 and b3 are parameters that may be pre-calculated and tabulated for various values of $D_E$ as shown in Table 3 that appears in the accompanying FIG. 8B. As expected, at $D_E=1$, we recover Eq. 6. One can easily also extend the concept of spectral Entropy to capture dissociation. For example, instead of just calculating the entropies based on the m/z distributions, a m/z to mass deconvolution step is first performed on the product ion spectrum to obtain the charges and molecular weights of the product ions. The molecular weight Entropy and charge state Entropy can be readily defined based on the distribution of product ion molecular weight and charge, respectively.

The above-written Eq. 9 may be employed to determine a value of collision energy that be experimentally applied, during HCD fragmentation, so as to yield a spread of product-ion m/z values that corresponds to a given value of the entropy parameter, $D_E$, as calculated according to the above discussion. To the inventors' knowledge, this is the first instance in which a model of applied collision energy has been proposed that is based on a desired property of an assemblage of product ions. The present invention is not limited to the use of the particular metric ($D_E$) for representing the distribution or spread of product ions, as other alternative metrics of the product-ion m/z spread may be advantageous in certain particular situations.

The b1, b2, and b3 values that are tabulated in each line of Table 3 are associated with a certain product-ion spread ("entropy fraction"), $D_E$, as given by Eq. 8, where $D_E$ is in the range {0.1, 0.2, . . . , 2.0}. The default level of 1.0 corresponds to an entropy maximum $E_{max}$ of the fragment spectrum, and the corresponding set of parameters results from modeling the relationship between MW, z, and the collision energy at which $E_{max}$ was observed. Levels below and above 1.0 are associated with a fraction of $E_{max}$ and may be modeled separately to provide best-fit collision energies for lower and higher degrees of fragmentation, respectively. In general, it may be necessary to determine the parameters $p_1$, $p_2$, $p_3$ (that is to perform a calibration) for any particular instrument by acquiring initial test data of known standards, as described above, prior to performing experiments on or analyses of samples containing unknown compounds.

Real-Time Fine Calibration

Minor instrument-to-instrument variability, and temporal drift of any particular instrument should be expected. With this in mind, a mechanism of automatically correcting for variability is provided that results in a fixed offset of any given model. For example, given the Entropy model, of $D_E$ is set to 0.68, and the rolling average $D_E$ from the most recent mass spectra (such as the 100 most recent mass spectra) differs by a value greater than +/−15% of this value, the system should auto-adjust to bring the actual measured $D_E$ closer to the requested "target" $D_E$. We expect that a simple multiplicative correction factor will suffice, without changing the coefficients of the basic equations.

Adaptation of Conventional Charge-State Correction Factors to New Methods

Figure 9A:
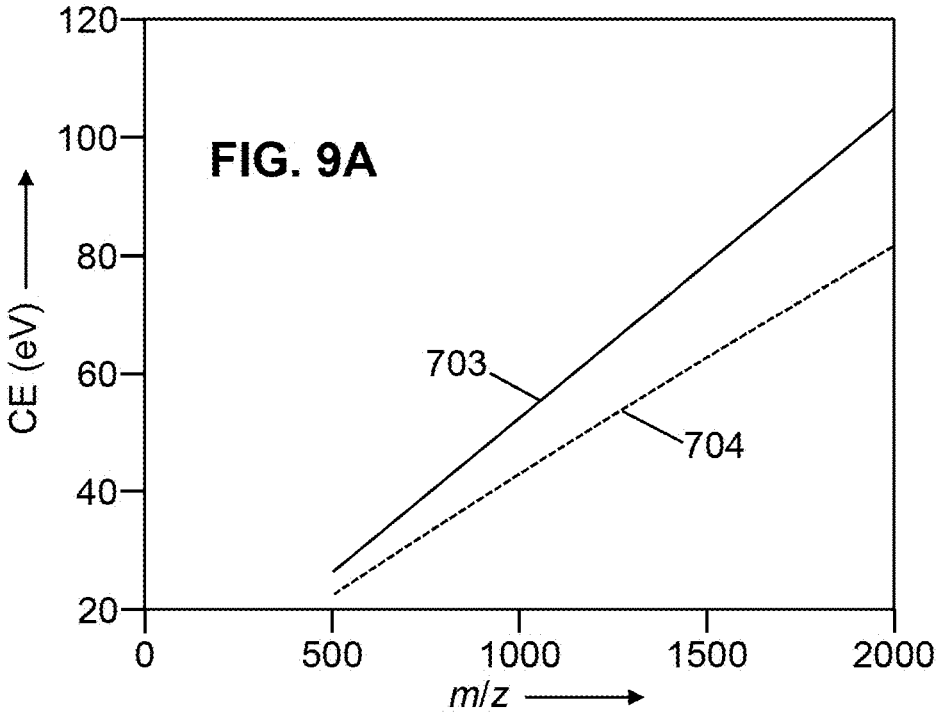
FIG. 9A is a comparison of between conventionally calculated collision energies (solid line) and collision energies calculated in accordance with the entropy model of the present teachings (dashed line), as functions of mass-to-charge ratio and for an ion charge state of +5 and a default setting of conventional relative collision energy.
Figure 9B:
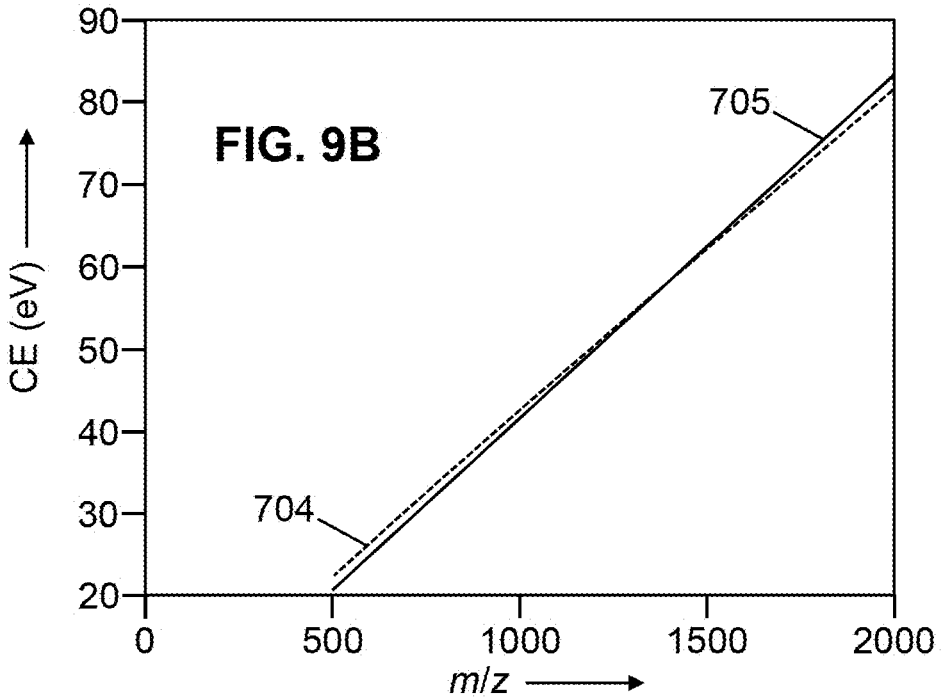
FIG. 9B is a comparison of between scaled conventionally calculated collision energies (solid line) and collision energies calculated in accordance with the entropy model of the present teachings (dashed line), where the conventionally-calculated collision energies of FIG. 9A are scaled by a scaling factor of 0.79475.
Figure 10:
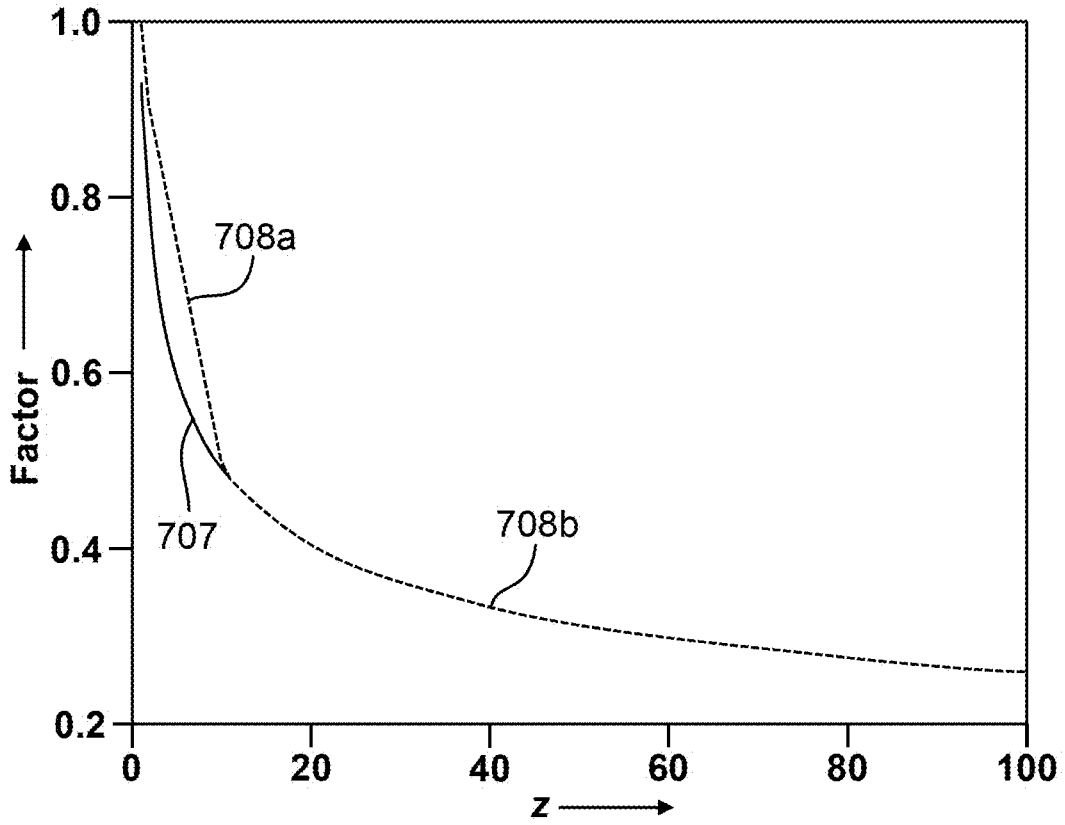
FIG. 10 is a graph of charge state scaling factors that may be applied to conventionally calculated collision energies to make those conventionally calculated collision energies consistent with certain calculated results determined in accordance with the present teachings.

FIG. 9A shows a comparison of between the collision energy conventionally calculated (curve 703) using the Normalized Collision Energy (NCE) approach as described in U.S. Pat. No. 6,124,591 with z=5 and relative collision energy (RCE) of 35% to the collision energy calculated (curve 704) according to the entropy model using an entropy fraction $D_E$, of 1.0. For purpose of the entropy model calculations, molecular weight was calculated as (m/z−1.007)×z. Like the NCE curve, which is a straight line by definition, the curve calculated according to the entropy model appears to be linear in the relevant m/z range 500 . . . 2000. Hence, it should be possible to apply a scaling factor to the NCE curve to obtain a fitted curve matching the trend of collision energy values calculated by the entropy model. Indeed, the fitted curve 705 matches the entropy-model curve very well (FIG. 9B). This type of scaling, using curve fitting, can be performed for all charge states in the range 1 . . . 100 with basically the same goodness of fit (data not shown).

The resulting scaling factors for the first 5 charge states are significantly lower than 1, which means that the entropy model tends to assign lower collision energies than the standard NCE method using the default RCE value of 35%. Thus, the scaling factors for z={1 . . . 5} resulting from the fit deviate significantly from the conventional correction factors use din the normalized collision energy model, and a similar deviation is to be expected for "intermediate" charge states in the range 6 . . . 10 or so (when extrapolating the RCE correction factors to higher charge states >5). However, changing the established correction factors (Table 1) for low charge states should be avoided for compatibility reasons.

To solve this issue, both approaches have been combined as follows: The curve of conventional correction factors is extrapolated in steps of −0.05 until it intersects with the curve of scaling factors determined herein by curve fitting. This intersection is observed at z≈10, which marks the transition of the conventional approach to the novel entropy approach described herein. The resulting scaling factors are illustrated as curves 708*a* and 708*b* in FIG. 10. Thus, the resulting extended NCE curve (FIG. 10, curves 708*a* and 708*b*) is defined as follows:

- For z={1 . . . 5}, the conventional correction factors given in Table 1 are used.
- For z={6 . . . 10}, correction factors are extrapolated by decreasing the last value f(5)=0.75 in 0.05 steps, i.e., f(z={6 . . . 10})={0.70, 0.65, 0.60, 0.55, 0.50}.
- For z>10, correction factors are given by the scaling factors resulting from the aforementioned fits, normalized to the applied NCE correction factor of 0.75 (to avoid using double scaling).

The extended NCE factors are given in Table 4, which is shown in FIG. 11.

Summary of Example of Molecular Weight Computational Method

The above-described models require foreknowledge of an analyte's molecular weight in order to estimate an optimal collision energy to be used in fragmenting selected ions of that analyte. In the case of ions of protein and polypeptide molecules that are ionized by electrospray ionization, the ions predominantly comprise the intact molecules having multiple adducted protons. In this case, the charge on each major analyte ion species is equal to just the number of adducted protons. In such situations, molecular weights can be readily determined, at least in theory, provided that the various multiply-protonated molecular ion species represented in a mass spectrum can be identified and assigned to groups (that is, charge-state series) in accordance with their molecular provenance. Unfortunately, the process of making of such identifications and assignments is often complicated by the fact that a typical mass spectrum often includes lines representative of multiple overlapping charge state series and is further complicated by the fact that the signature of each ion species of a given charge state may be split by isotopic variation.

As biologically-derived samples are generally very complex, a single MS spectrum can easily contain hundreds to even thousands of peaks which belong to different analytes—all interwoven over a given m/z range in which the ion signals of very different intensities overlap and suppress one other. The resulting computational challenge is to trace each peak back to a certain analyte(s). The elimination of "noise" and determination of correct charge assignments are the first step in tackling this challenge. Once the charge of a peak is determined, then one can further use known relationships between the charge states in a charge state series to group analyte related charge states. This information can be further used to determine molecular weight of analyte(s) in a process which is best described as mathematical decomposition (also referred to, in the art, as mathematical deconvolutions).

Further, the mathematical deconvolution required to identify the various overlapping charge state series must be performed in "real time" (that is, at the time that mass spectral data is being acquired), since the deconvolved results of a precursor-ion mass spectrum are immediately used to both select ion species for dissociation and to determine appropriate collision energies to be applied during the dissociation, where the applied collision energies may be different for different species. To succeed, one needs to have a data acquisition strategy that anticipates multiple mass spectral lines for each ion species and an optimized real time data analysis strategy. In general, the deconvolution process should be accomplished in less than one second of time. In United States pre-grant Publication No. 2016/0268112A1, the disclosure of which is hereby incorporated by reference herein in its entirety, an algorithm is described that achieves the required analyses of complex samples within such time constraints, running as application software. Alternatively, co-pending European Patent Application No. 16188157, filed on Sep. 9, 2016, teaches methods for another suitable mathematical deconvolution algorithm. The text of the aforementioned European application is included as an appendix to this document and the drawing therefrom is included as FIG. 14 of the accompanying set of drawings. The algorithm could be encoded into a hardware processor coupled to a mass spectrometer instrument so as to run even faster. The following paragraphs briefly summarize some of the major features of the computational deconvolution algorithm described in the aforementioned patent application publication No. 2016/0268112A1.

Use of Centroids Exclusively.

Standard mass spectral charge assignment algorithms use full profile data of the lines in a mass spectrum. By contrast, the computational approach which is described in U.S. pre-grant Publ. No. 2016/0268112A1 uses centroids. The key advantage of using centroids over line profiles is data reduction. Typically the number of profile data points is about an order of magnitude larger than that of the centroids. Any algorithm that uses centroids will gain a significant advantage in computational efficiency over that standard assignment method. For applications that demand real-time charge assignment, it is preferable to design an algorithm that only requires centroid data. The main disadvantage to using centroids is imprecision of the m/z values. Factors such as mass accuracy, resolution and peak picking efficiency all tend to compromise the quality of the centroid data. But these concerns can be mostly mitigated by factoring in the m/z imprecision into the algorithm which employs centroid data.

Intensity is Binary.

As described in U.S. pre-grant Publ. No. 2016/0268112A1, mass spectral line intensities are encoded as binary (or Boolean) variables (true/false or present/absent). The Boolean methods only take into consideration whether a centroid intensity is above a threshold or not. If the intensity value meets a user-settable criterion based on signal intensity or signal-to-noise ratio or both, then that intensity value assumes a Boolean "True" value, otherwise a value of "False" is assigned, regardless of the actual numerical value of the intensity. A well-known disadvantage of using a Boolean value is the loss of information. However, if one has an abundance of data points to work with—for example, thousands of centroids in a typical high resolution spectrum, the loss of intensity information is more than compensated for by the sheer number of Boolean variables. Accordingly, the referenced deconvolution algorithms exploit this data abundance to achieve both efficiency and accuracy.

Additional accuracy without significant computational speed loss can be realized by using, in alternative embodiments, approximate intensity values rather than just a Boolean true/false variable. For example, one can envision the situation where only peaks of similar heights are compared to each other. One can easily accommodate the added information by discretizing the intensity values into a small number of low-resolution bins (e.g., "low", "medium", "high" and "very high"). Such binning can achieve a good balance of having "height information" without sacrificing the computational simplicity of a very simplified, representation of intensities.

In order to achieve computational efficiency comparable to that using Boolean variables alone while nonetheless incorporating intensity information, one approach is to encode the intensity as a byte, which is the same size as the Boolean variable. One can easily achieve this by using the logarithm of the intensity (instead of raw intensity) in the calculations together with a suitable logarithm base. One can further cast the logarithm of intensity as an integer. If the logarithm base is chosen appropriately, the log (intensity) values will all fall comfortably within the range of values 0-255, which may be represented as a byte. In addition, the rounding error in transforming a double-precision variable to an integer may be minimized by careful choice of logarithm base.

To further minimize any performance degradation that might be incurred from byre arithmetic (instead of Boolean arithmetic), the calculations may that are employed to separate or group centroids only need to compute ratios of intensities, instead of the byte-valued intensities themselves. The ratios can be computed extremely efficiently because: 1) instead of using a floating point division, the logarithm of a ratio is simply the difference of logarithms, which in this case, translates to just a subtraction of two bytes, and 2) to recover the exact ratio from the difference in log values one only needs to perform an exponentiation of the difference in logarithms. Since such calculations will only encounter the exponential of a limited and predefined set of numbers (i.e. all possible integral differences between 2 bytes (−255 to +255), the exponentials can be pre-computed and stored as a look-up array. Thus by using a byte representation of the log intensities and a pre-computed exponential lookup array, computational efficiency is not compromised.

Binning of Mass-to-Charge Values

As described in U.S. pre-grant Publ. No. 2016/0268112A1, mass-to-charge values are transformed and assembled into low-resolution bins and relative charge state intervals are pre-computed once and cached for efficiency. Further, m/z values of mass spectral lines are transformed from their normal linear scale in Daltons into a more natural dimensionless logarithmic representation. This transformation greatly simplifies the computation of m/z values for any peaks that belong to the same protein, for example, but represent potentially different charge states. The transformation involves no compromise in precision. When performing calculations with the transformed variables, one can take advantage of cached relative m/z values to improve the computational efficiency.

Simple Counting-Based Scoring of Charge States and Statistical Selection Criteria.

As described in U.S. pre-grant Publ. No. 2016/0268112A1, the whole content of any mass spectrum in question is encoded into a single Boolean-valued array. The scoring of charge states to centroids reduces to just a simple counting of yes or no (true or false) of the Boolean variables at transformed m/z positions appropriate to the charge states being queried. This approach bypasses computationally expensive operations involving double-precision variables. Once the scores are compiled for a range of potential charge states, the optimal value can easily be picked out by a simple statistical procedure. Using a statistical criterion is more rigorous and reliable than using an arbitrary score cutoff or just picking the highest scoring charge state.

Iterative Refinement at Charge State Assignments

The teachings of the aforementioned U.S. pre-grant Publ. No. 2016/0268112A1 use an iterative process that is defined by complete self-consistency of charge assignment. The final key feature of the approach is the use of an appropriate optimality condition that leads the charge-assignment towards a solution. The optimal condition is simply defined to be most consistent assignment of charges of all centroids of the spectra. Underlying this condition is the reasoning that the charge state assigned to each centroid should be consistent with those assigned to other centroids in the spectrum. The algorithm described in the publication implements an iterative procedure to generate the charge state assignments as guided by the above optimally condition. This procedure conforms to accepted norms of an optimization procedure. That is, an appropriate optimally condition is first defined and then an algorithm is designed to meet this condition and, finally, one can then judge the effectiveness of the algorithm in how well it satisfies the optimality condition.

Example of Mass Spectral Deconvolution Results

Figure 13A:
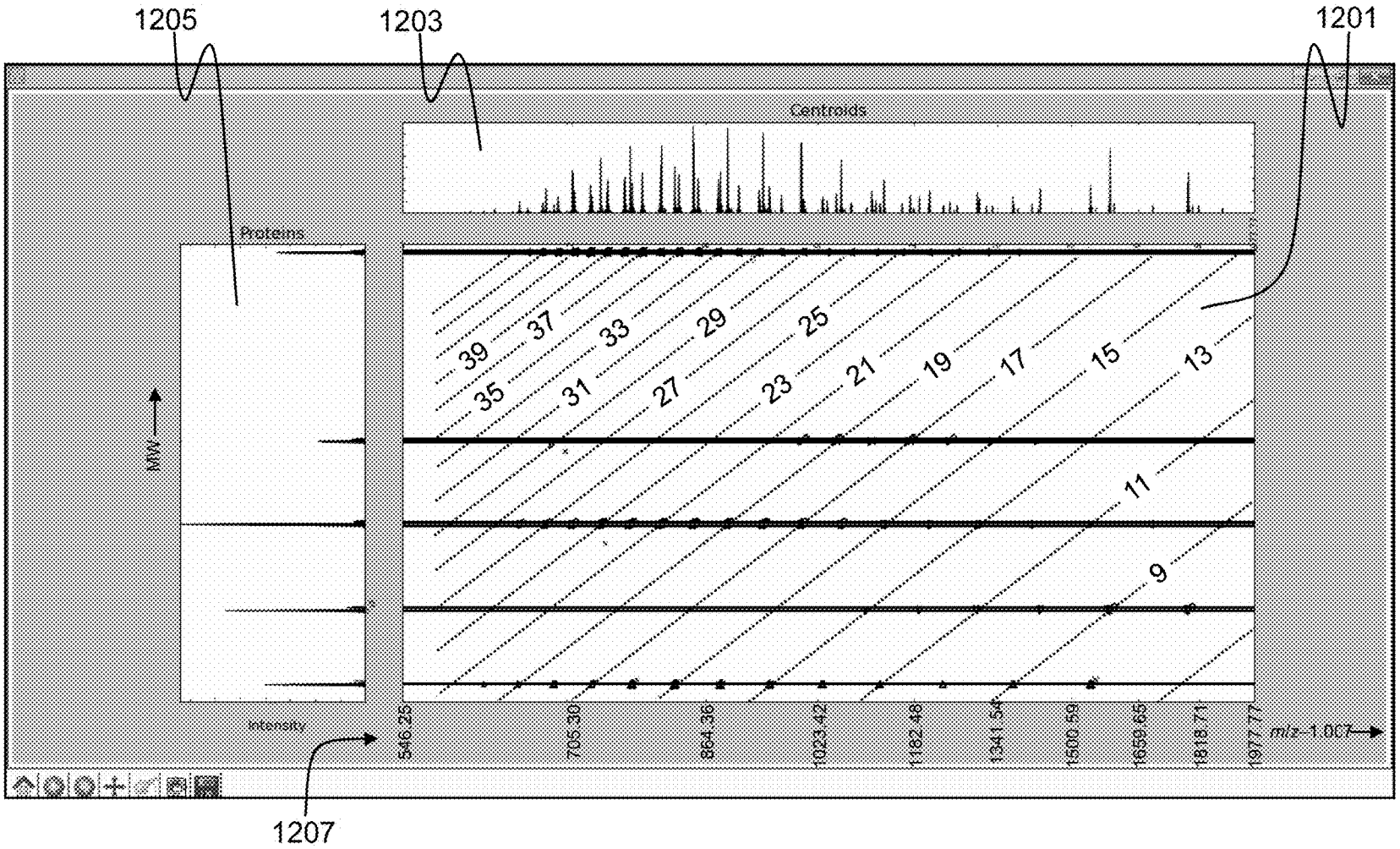
FIG. 13A is a depiction of a computer screen information display illustrating peak cluster decomposition results, as generated by computer software employing methods in accordance with the present teachings, calculated from a mass spectrum of a five-component protein mixture consisting of cytochrome-c, lysozyme, myoglobin, trypsin inhibitor, and carbonic anhydrase.
Figure 13B:
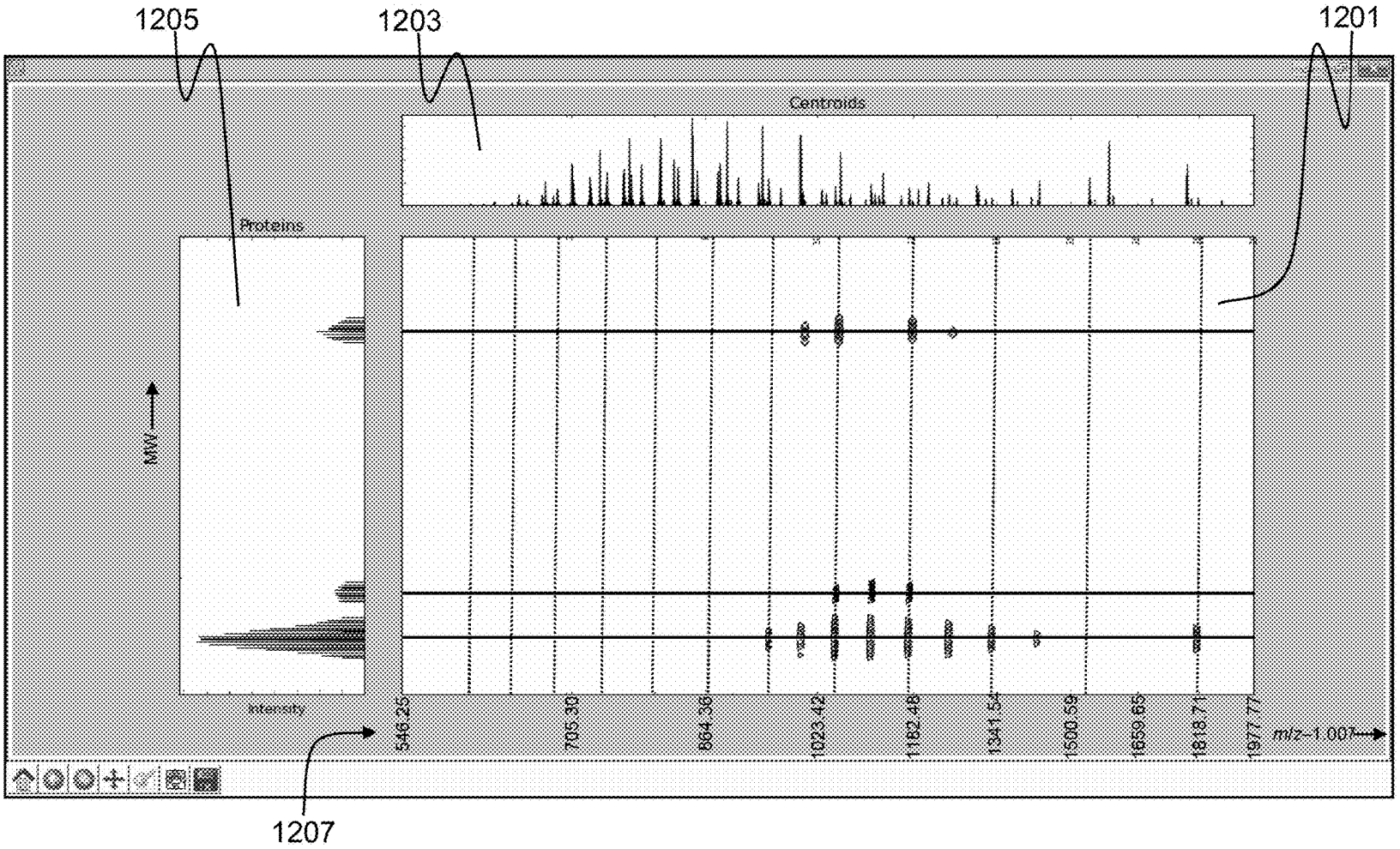
FIG. 13B is a depiction of a computer screen information display illustrating peak cluster decomposition results, as generated by computer software employing methods in accordance with the present teachings, the display illustrating an expanded portion of the decomposition results shown in FIG. 13A.

FIG. 13A shows the deconvolution result from a five component protein mixture consisting of cytochrome c, lysozyme, myoglobin, trypsin inhibitor, and carbonic anhydrase, where the deconvolution was performed according to the teachings of U.S. pre-grant Publ. No. 2016/0268112A1. A top display panel 1203 of the graphical user interface display shows the acquired data from the mass spectrometry represented as centroids. A centrally located main display panel 1203 illustrates each peak as a respective symbol. The horizontally disposed mass-to-charge (m/z) scale 1207 for both the top panel 1203 and central panel 1201 is shown below the central panel. The panel 1205 on the left hand side of the display shows the calculated molecular weight(s) in daltons, of protein molecules. The molecular weight (MW) scale of the side panel 1205 is oriented vertically on the display, which is perpendicular to the horizontally oriented m/z scale 1207 that pertains to detected ions. Each horizontal line in the central panel 1201 indicates the detection of a protein in this example with the dotted contour lines corresponding to the algorithmically-assigned ion charge states, which are displayed as a direct result of the transformation calculation discussed previously. In FIG. 13B is shown a display pertaining to the same data set in which the molecular weight (MW) scale is greatly expanded with respect to the view shown in FIG. 13A. The expanded view of FIG. 13B illustrates well-resolved isotopes for a single protein charge state (lowermost portion of left hand panel 1205) as well as potential adduct or impurity peaks (two present in the displays). The most intense of these three molecules is that of trypsin inhibitor protein.

Figure 12:
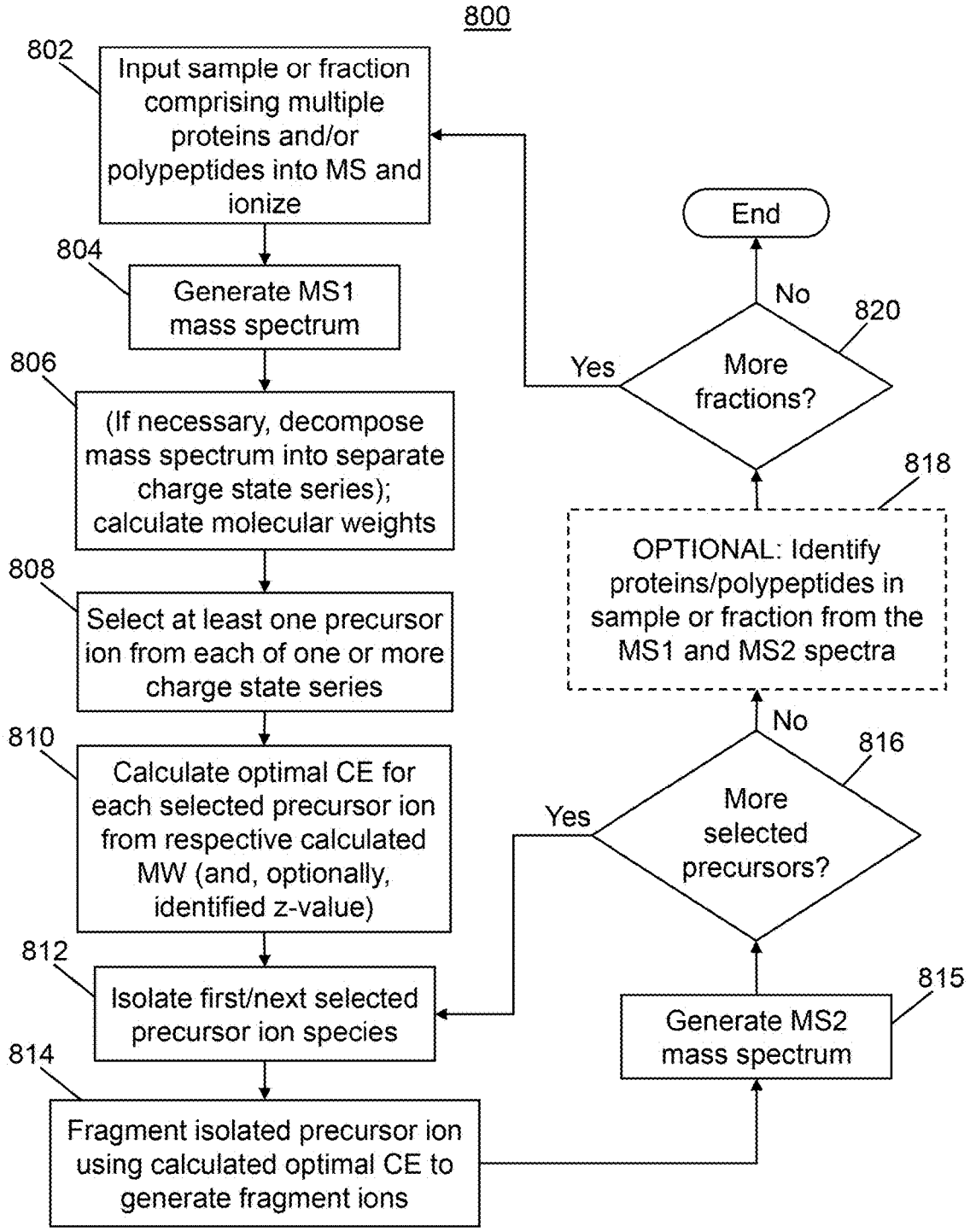
FIG. 12 is a flow diagram of a method, in accordance with the present teachings, for tandem mass spectral analysis of proteins or polypeptides using automated collision energy determination.

FIG. 12 is a flow diagram of a method, Method 800, in accordance with the present teachings, for tandem mass spectral analysis of proteins or polypeptides using automated collision energy determination. In Step 802 of the Method 800 (FIG. 12), a sample or sample fraction comprising multiple proteins and/or polypeptides is input into a mass spectrometer and ionized. Preferably, the ionization is performed by an ionization technique or an ionization source that generates ion species of a type that enables calculation of the molecular weights of various of the protein or polypeptide compounds from measurements of the ions' mass-to-charge ratios (m/z). In particular, it is preferable that the ionization technique or ionization source produces, from each analyte compound, ion species that comprise a series of charge states, where each such ion species comprises an otherwise intact molecule of the analyte compound, but comprising one or more adducts. Electrospray and thermospray ionization are two examples of suitable ionization techniques, since the major ion species generated from proteins and/or polypeptides by these particular ionization techniques are multi-protonated molecules having various degrees of protonation. The ions generated by the ionization source and introduced into the mass spectrometer from the ion source may be referred to as "first-generation ions".

After their introduction into the mass spectrometer, the first-generation ions are mass analyzed in Step 804 so as to generate a mass spectrum, which is here referred to as an "MS1" mass spectrum so to indicate that it relates to the first-generation ions. The mass spectrum is a simple list or table, generally maintained in computer-readable memory, of the ion current (intensity, which is proportional to a number of detected ions) as it is measured at each of a plurality of m/z values. Then, in Step 806, the MS1 spectrum is automatically examined in a fashion that enables calculation of the molecular weights of various of the protein or polypeptide compounds from the m/z ratios of ions whose presence is detected in the mass spectrum. Execution of this step may require, if necessary, prior mathematical decomposition (deconvolution) of the mass spectral data into separate identified charge-state series, where each-charge state corresponds to a different respective protein or polypeptide compound. The mathematical deconvolution and identification of charge-state series may be performed according to the methods described in the aforementioned U.S. pre-grant Publ. No. 2016/0268112A1 that is summarized above. Alternatively, the mathematical deconvolution may be performed by any equivalent algorithm. For example, co-pending European Patent Application No. 16188157, filed on Sep. 9, 2016, teaches such an alternative mathematical algorithm. The text of the aforementioned European application is included as an appendix to this document and the drawing therefrom is included as FIG. 14 of the accompanying set of drawings. In some cases, the algorithm should be one that is optimized so that the required deconvolution may be performed within time constraints imposed by a mass spectral experiment of which the method 800 is a part.

In Step 808 of the Method 800 (FIG. 12), at least one precursor ion species, of a respective m/z, is selected from each of one or more charge state series identified in the prior step. Preferably, if more than one precursor ion is selected, the different precursor ions are selected from different charge state series. Then, in Step 810, an optimal collision energy (CE) is calculated for each selected precursor ion species, where each calculated optimal collision energy is later to be imparted to ions of the respective selected precursor-ion species in an ion fragmentation step, and where the calculated molecular weight of the molecule from winch the respective selected ion species was generated is used in the calculation of the optimal collision energy associated with that ion species. Optionally, the respective identified z-value of each respective selected ion species may be included in the calculation of the optimal collision energy associated with that ion species.

The calculation of the optimal collision energies in Step 810 may be in accordance with the methods taught herein. For instance, if the optimal collision energy is chosen so as to leave a residual remaining percentage of precursor-ion intensity, $D_p$, remaining after the fragmentation, then Eq. 2 may be used to calculate the collision energy, where the parameters c and k are determined either from Eq. 3 and Eq. 4 or else are calculated from equations of the form of these two equations but with different numerical values determined from a prior calibration of a particular mass spectrometer apparatus. Alternatively, the optimal collision energy may be chosen so as to leave a residual remaining percentage of precursor-ion intensity, $D_p$, remaining after the fragmentation using Eq. 5 in conjunction with the parameter values listed in Table 2. As a still-further alternative, the optimal collision energy may be chosen so that the distribution of product ions existing after fragmentation of the selected precursor-ion species is an accordance with a certain desired entropy parameter, $D_E$, using Eq. 9 in conjunction with the parameter values listed in Table 3.

In Step 812 of the method 800, a selected precursor-ion species is isolated within the mass spectrometer by known isolation means. For example, if the MS1 ion species are temporarily stored within a multipole ion trap apparatus, a supplemental oscillatory voltage (a supplemental AC voltage) may be applied to electrodes of the trap such that all species other than the particular selected species are expelled front the trap, thereby leaving only the selected species isolated within the trap. Subsequently, in Step 814, the ions of the selected and isolated precursor-ion species are fragmented by the HCD technique so as to generate fragment ions, where the previously-calculated optimal collision energy is imparted to the selected ions to initiate the fragmentation. In Step 815, a mass spectrum of the fragment ions (i.e., an MS2 spectrum) is acquired and stored in computer readable memory.

If, after execution of Step 815, there are any remaining selected precursor ion species that have not been fragmented, then execution returns to Step 814 and then Step 815 in which ions of another selected precursor-ion species are isolated and fragmented. Otherwise, execution proceeds to either Step 818 or Step 820. In Step 818, the m/z or molecular weight of a selected precursor ion obtained from its MS1 spectrum is combined with information from the MS2 spectrum to either identify or to determine structural information about a polypeptide or protein in the analyzed sample or sample fraction. The optional Step 818 need not be executed immediately after Step 816 and may be delayed until just prior to the termination of the method 800 or may, in fact, be executed at a later time provided that the information from the relevant MS1 and MS2 spectra is stored for later use and analysis. Lastly, if it is determined, at Step 820, that additional samples or sample fractions remain to be analyzed, then execution returns to Step 802 at which the next sample or sample fraction is analyzed. The various sample fractions may be generated by fractionation of an initially homogeneous sample, such as by capillary electrophoresis, liquid chromatography, etc. so that the material that is input to the mass spectrometer at each execution of step 802 is chemically simpler than an original unfractionated sample. Certain measured aspects of the fractionation, such as observed retention times, may be combined with corresponding MS1 and MS2 information in order to identify one or more analytes during a subsequent execution of Step 818.

Conclusion: Tests of the Models

Both the precursor decay and Entropy models were tested by incorporating the associated parameters, $D_p$ and $D_E$, as well as the mass spectral deconvolution algorithm of the aforementioned U.S. pre-grant Publ. No. 2016/0268112A1 into existing data acquisition control software. The protein fraction of *E. coli* cell lysates were analyzed by MS/MS analysis of liquid chromatographic tractions using both precursor-ion decay and product-ion entropy models, as well as by a variety of optimized fixed normalized collision energies. In these experiments, it was observed that using either model to calculate optimal collision energy results in an improvement to the control over extent of dissociation relative to an optimized fixed conventional normalized collision energy scheme. This improved fragmentation, using the methods of the present teachings, has led, in various datasets, to improvement in protein identifications.

Appendix: Method for Identification of the Monoisotopic Mass of Species of Molecules

TECHNICAL FIELD OF THE INVENTION

The invention belongs to the methods for identification of the monoisotopic mass or a parameter correlated the mass of the isotopes of the isotope distribution of at least one species of molecules. The method is using a mass spectrometer to measure a mass spectrum of a sample. With the method the monoisotopic mass or a parameter correlated the mass of the isotopes of the isotope distribution can be identified of species of molecules which are contained in the sample investigated by the mass spectrometer or originated from a the sample investigated by the mass spectrometer by at least an ionisation process. Preferably the ionization process creates the ions analyzed by the mass spectrometer.

BACKGROUND OF THE INVENTION

Methods to identity at least the monoisotopic mass or a parameter correlated the mass of the isotopes of the isotope distribution of one species of molecules, mostly various species of molecules, are in general available. Preferably these methods are used to identify the monoisotopic mass of large molecules like peptides, proteins, nucleic acids, lipids and carbohydrates having typically a mass of typically between 200 u and 5,000,000 u, preferably between 500 u and 100,000 u and particularly preferably between 5,000 u and 50,000 u.

These methods are used to investigate samples. These samples may contain species of molecules which can be identified by their monoisotopic mass or a parameter correlated the mass of the isotopes of their isotope distribution.

A species of molecules is defined as a class of molecules having the same molecular formula (e.g. water has the molecular formula $H_2O$ and methane the molecular formula $CH_4$.)

Or the investigated sample can be better understood by ions which are generated from the sample by at least an ionisation process. The ions may be preferably generated by electrospray ionisation (ESI), matrix-assisted laser desorption ionisation (MALDI), plasma ionisation, electron ionisation (EI), chemical ionisation (CI) and atmospheric pressure chemical ionization (APCI). The generated ions are charged particles mostly having a molecular geometry and a corresponding molecular formula. In the context of this patent application the term "species of molecules originated from a sample by at least an ionisation process" shall be understood is referring to the molecular formula of an ion which is originated from a sample by at least an ionisation process. So monoisotopic mass or a parameter correlated the mass of the isotopes of the isotope distribution of a species of molecules originated from a sample by at least an ionisation process can be deduced from the ion which is originated from a sample by at least an ionisation process by looking for the molecular formula of the ion after the charge of the ion has been reduced to zero and changing the molecular formula accordingly to the ionisation process as described below.

In the species of molecules all molecules have the same composition of atoms according to the molecular formula. But most atoms of the molecule can occur as different isotopes. For example the basic element of the organic chemistry, the carbon atom occurs in two stable isotopes, the $^{12}C$ isotope with a natural probability of occurrence of 98.9% and the $^{13}C$ isotope (having one more neutron in its atomic nucleus) with a natural probability of occurrence of 1.1%. Due to this probabilities of occurrence of the isotopes particularly complex molecules of higher mass consisting of a higher number of atoms have a lot of isotopomers, in which the atoms of the molecule exist as different isotopes. In the whole context of the patent application these isotopomers of a species of molecule designated as the "isotopes of the species of molecule". These isotopes have different masses resulting in a mass distribution of the isotopes of species of molecules, named in the content of this patent application isotope distribution (short term: ID) of the species of molecules. Each species of molecules therefore can have different masses but for a better understanding and identification of a species of molecules to each molecule is assigned a monoisotopic mass. This is the mass of a molecule when each atom of the molecule exists as the isotope with the lowest mass. For example a methane molecule has the molecular formula $CH_4$ and hydrogen has the isotopes $^1H$ having on a proton in his nucleus and $^2H$ (deuterium) having an additional neutron in his nucleus. So the isotope of the lowest mass of carbon is $^{12}C$ and the isotope of the lowest mass of hydrogen is $^1H$. Accordingly the monoisotopic mass of methane is 16 u. But there is a small propability of other methane isotopes having the masses 17 u, 18 u, 19 u, 20 u and 21 u. All these other isotopes belong to the isotope distribution of methane and can be visable in the mass spectrum of a mass spectrometer.

The identification of the monoisotopic mass or a parameter correlated the mass of the isotopes of the isotope distribution of at least one species of molecules is by measuring a mass spectrum of the investigated sample with by amass spectrometer. In general every kind of mass spectrometer can be used known to a person skilled in the art to measure a mass spectrum of the sample. In particular it is preferred to use a mass spectrometer of high resolution like a mass spectrometer having an Orbitrap as mass analyser, a FT-mass spectrometer, an ICR mass spectrometer or an MR-TOF mass spectrometer. Other mass spectrometers for which the inventive method can be applied are particularly TOF mass spectrometer and mass spectrometer with a HR quadrupole mass analyser. But to identify the monoisotopic mass or a parameter correlated the mass of the isotopes of the isotope distribution of species of molecules if the mass spectrum is measured with a mass spectrometer having a low resolution is difficult with the known method of identification, in particular because neighbouring peaks of isotopes having a mass difference of 1 u cannot be distinguished.

On the one hand molecules already present in the sample are set free and are only charged by the ionization process e.g. by the reception and/or emission of electrons. The method of the invention is able to assign to these species of molecules contained in the sample its monoisotopic mass due to their ions which are detected in the mass spectrum of the mass spectrometer.

On the other hand the ionisation process can change the molecules contained in the sample by fragmentation to smaller charged particles or addition of atoms or molecules to the molecules contained in the sample resulting in larger molecules which are charged due to the process. Also by an ionisation process the matrix of a sample can be splitted in molecules which are charged. So all these ions are originated from the sample by a described ionisation process. So for these ions the accordingly species of the molecules originated from the sample have to be investigated by a method for identification of the monoisotopic mass or a parameter correlated the mass of the isotopes of the isotope distribution of at least one species of molecules.

To date, many methods to identify monoisotopic masses of isotopic peaks in mass spectra have been published, including Patterson functions, Fourier transforms, or a combination thereof (M. W. Senko et al., *J. Am. Soc. Mass Spectrom.* 1995, 6, 52; D. M. Horn et al., *J. Am. Soc. Mass Spectrom.* 2000, 11, 320; L. Chen & Y. L. Yap, *J. Am. Soc. Mass Spectrom.* 2008, 19, 46), m/z accuracy scores (Z. Zhang & A. G. Marshall, *J. Am. Soc. Mass Spectrom.* 1998, 9, 225), fits of experimentally observed peak patterns to theoretical models (P. Kaur & P. B. O'Connor, *J. Am. Soc. Mass Spectrom.* 2006, 17, 459; X. Liu et al., *Mol. Cell Proteomics* 2010, 9, 2772), and entropy-based deconvolution algorithms (B. B. Reinhold & V. N. Reinhold, *J. Am.*

*Soc. Mass Spectrom.* 1992, 3, 207). These methods are often targeted at specific applications such as peptides and/or intact proteins and the reported executing times are in the seconds time range on a 2.2-GHz CPU (Liu et al., 2010), which is not sufficient for an online detection and subsequent selection of species for a further MS analysis, as in standard methods of MS proteomics. A unpublished method of P. Yip et al., has been optimized for the analysis of intact proteins, using a high number of correlations of potentially related peaks, which have been transformed before from the original data to a logarithmic m/z axis with binary intensity information. However, with the speed is not fast enough for the use for a Fourier-transform mass spectrometer. Evidently, a holistic approach, which is not only suitable for a broader range of applications, including peptides, small organic molecules, and intact proteins, but also for a fast online analysis directly after the data acquisition (without delaying the acquisition of subsequent scans), is required for areas of applications where acquisition speed, i.e., the amount of data that can be analyzed experimentally per unit of time, is essential.

SUMMARY OF THE INVENTION

The above mentioned objects are solved by a new method for identification of the monoisotopic mass or a parameter correlated to the mass of the isotopes of the isotope distribution of at least one species of molecules contained in a sample and/or originated from a sample by at least an ionisation process according to claim 1.

The inventive method comprising the following steps:

(i) measuring a mass spectrum of the sample with a mass spectrometer (ii) dividing at least one range of measured m/z values of the mass spectrum of the sample into fractions (iii) assigning at least some of the fractions of the at least one range of measured m/z values to one processor of several provided processors (iv) deducing for each of the at least one species of molecules contained in the sample and/or originated from a sample from the measured mass spectrum in at least one of the fractions of the at least one range of measured m/z values an isotope distribution of their ions having a specific charge z and (v) deducing from at least one deduced isotope distribution of the ions of each of the at least one species of molecules contained in the sample and/or originated from the sample the monoisotopic mass or a parameter correlated to the mass of the isotopes of the isotope distribution of the species of molecules.

In an embodiment of the inventive method for identification of the monoisotopic mass or a parameter correlated to the mass of the isotopes of the isotope distribution of at least one species of molecules contained in a sample and/or originated from a sample by at least an ionisation process wherein in each of the fractions of at least one range of measured m/z values at least one isotope distribution of ions of one species of molecules having a specific charge z is detected.

In an embodiment of the inventive method for identification of the monoisotopic mass or a parameter correlated to the mass of the isotopes of the isotope distribution of at least one species of molecules contained in a sample and/or originated from a sample by at least an ionisation process for at least one other specifies of molecules than the at least one species of molecules a isotope distribution of their ions having a specific charge z is deduced in at least one of the fractions at least one range of measured m/z values.

In an embodiment of the inventive method for identification of the monoisotopic mass or a parameter correlated to the mass of the isotopes of the isotope distribution of at least one species of molecules contained in a sample and/or originated from a sample by at least an ionisation process wherein for some of the species of molecules contained in the sample and/or originated from the sample by at least an ionisation process the monoisotopic mass or a parameter correlated the mass of the isotopes of the isotope distribution is deduced from two or more deduced isotope distributions of their ions having a different specific charge z.

In an embodiment of the inventive method for identification of the monoisotopic mass or a parameter correlated to the mass of the isotopes of the isotope distribution of at least one species of molecules contained in a sample according and/or originated from a sample by at least an ionisation process for some of the species of molecules contained in the sample and/or originated from the sample by at least an ionisation process the monoisotopic mass or a parameter correlated to the mass of the isotopes of the istope distribution is deduced from two or more isotope distributions of their ions having a different specific charge z which are deduced from different fractions of the at least one range of measured m/z values.

In an embodiment of the inventive method for identification of the monoisotopic mass or parameter correlated to the mass of the isotopes of the isotope distribution of at least one species of molecules contained in a sample and/or originated from a sample by at least an ionisation process the monoisotopic mass or a parameter correlated the mass of the isotopes of the isotope distribution of each of the at least one species of molecules contained in the sample and/or originated from the sample by at least an ionisation process is deduced from at least one deducted isotope distribution of their ions having a specific charge z of the species of molecules in at least one of the fractions of the at least one range of measured m/z values by evaluating the isotope distributions of ions having a specific charge z deduced from different fractions of the at least one range of measured m/z values.

In a preferred embodiment of the inventive method for identification of the monoisotopic mass or a parameter correlated to the mass of the isotopes of the isotope distribution of at least one species of molecules contained in a sample and/or originated from a sample by at least an ionisation process the monoisotopic mass or parameter correlated to the mass of the isotopes of the isotope distribution of each of the at least one species of molecules contained in the sample and/or originated from a sample by at least an ionisation process is deduced from at least one deduced isotope distribution of their ions having a specific charge z of the species of molecules in at least one of the fractions of the at least one range of measured m/z value by evaluating the isotope distributions of ions having a specific charge z deduced from all fractions assigned to a processor.

In an embodiment of the inventive method for identification of the monoisotopic mass or a parameter correlated to the mass of the isotopes of the isotope distribution of at least one species of molecules contained in a sample for each of the at least one species of molecules contained in the sample and/or originated from the sample by at least an ionisation process at least one isotope distribution of their ions having a specific charge z is deduced from the measured mass spectrum by deducing a charge score $cs_{PX}(z)$ of a measured peak PX of the mass spectrum by multiplication of at least three of the four sub charge scores $cs_{P_PX}(z)$, $cs_{AS_PX}(z)$, $cs_{AC_PX}(z)$ and $cs_{IS_PX}(z)$.

In a preferred embodiment of the inventive method for identification of the monoisotopic mass or a parameter correlated to the mass of the isotopes of the isotope distribution of at least one species of molecules contained in a sample the charge score $cs_{PX}(z)$ of the measured peak PX of the mass spectrum is deduced by multiplication of the four sub charge scores $cs_{P_PX}(z)$, $cs_{AS_PX}(z)$, $cs_{AC_PX}(z)$ and $cs_{IS_PX}(z)$.

In an embodiment of the inventive method for identification of the monoisotopic mass or a parameter con elated to the mass of the isotopes of the isotope distribution of at least one species of molecules contained its a sample for each of the at least one species of molecules contained in the sample and/or originated from the sample by at least an ionisation process at least one isotope distribution of their ions having a specific charge z is deduced from the measured mass spectrum by deducing for each charge state J between the charge 1 and a maximum charge state $z_{max}$ the charge score $cs_{PX}(z)$ of the measured peak PX of the mass spectrum.

The above mentioned objects ate further solved by a new method for identification of the monoisotopic mass or a parameter correlated to the mass of the isotopes of the isotope distribution of at least one species of molecules contained in a sample and/or originated from a sample by at least an ionisation process according to claim 11.

The inventive method comprising the following steps:

(i) measuring a mass spectrum of the sample with a mass spectrometer (ii) deducing for each of the at least one species of molecules contained in the sample and/or originated from the sample by at least an ionisation process from the measured mass spectrum at least one isotope distribution of their ions having a specific charge z by deducing a charge score $cs_{PX}(z)$ of a measured peak of the mass spectrum by multiplication of at least three of the four sub charge scores $cs_{P_PX}(z)$, $cs_{AS_PX}(z)$, $cs_{AC_PX}(z)$ and $cs_{IS_PX}(z)$ and (iii) deducing from at least one deduced isotope distribution of ions having a specific charge z of each of the at least one species of molecules contained in the sample and/or originated from the sample by at least an ionisation process the monoisotopic mass or a parameter correlated to the mass of the isotopes of the isotope distribution of the species of molecules.

In a preferred embodiment of the inventive method for identification of the monoisotopic mass or parameter correlated to the mass of the isotopes of the istope distribution of at least one species of molecules contained in a sample and/or originated from a sample by at least an ionisation process wherein the charge score $cs_{PX}(z)$ of a measured peak of the mass spectrum is deduced by multiplication of the four sub charge $cs_{P_PX}(z)$, $cs_{AS_PX}(z)$, $cs_{AC_PX}(z)$ and $cs_{IS_PX}(z)$.

The above mentioned objects are further solved by a new method for identification of the monoisotopic mass or a parameter correlated to the mass of the isotopes of the isotope distribution of at least one species of molecules contained in a sample and/or originated from a sample by at least an ionisation process according to claim 13.

The inventive method comprising the following steps:

(i) measuring a mass spectrum of the sample with a mass spectrometer (ii) deducing for each of the at least one species of molecules contained in the sample and/or originated from the sample from the measured mass spectrum at least two isotope distributions of then ions having a specific charge z and (iii) deducing from the at least two deduced isotope distribution of the ions of each of the at least one species of molecules contained in the sample and/or originated from the sample the monoisotopic mass or a parameter correlated to the mass of the isotopes of the isotope distribution of the species of molecules.

The inventive method makes use of information from related isotope distributions of a species of molecules, which increases the accuracy of the identification of the monoisotopic mass a parameter correlated the mass of the isotopes of the isotope distribution of the species of molecules considerably. This is especially advantageous for intact proteins, which tend to form a extensive set of isotope distributions of the ions of a species of molecules with higher charge states due to the ionisation. Poorly resolved or completes unresolved IDs (i.e., IDs the isotopic peaks of which are not or only partly resolved) are handled dynamically by determining the maximally resolvable isotope distribution. Due to flexible m/z windows a separation of single IDs is presented. The implemented charge scores have been optimized for a broad range of applications, including peptides, small organic molecules (including those with uncommon isotopic peak patterns), and intact proteins. Generally, the detection and annotation is not limited to the averagine model for peptides/proteins. In contrast to the methods of the prior art, the inventive method allows assigning multiple isotope distributions to each species of molecules. To enhance the performance of the new method, time consuming procedures such as Fourier transforms are avoided and multi processing as well as speed-optimized processes are employed wherever possible. The inventive method uses the original intensities of the peaks to better distinguish between adjacent and overlapping IDs, which is particularly important for peptide data and mixtures of peptides and proteins. The new method takes less than 20 milliseconds to process mass spectra of complex protein samples (including the determination of monoisotopic masses) with a signal-to-noise threshold of 10 (meaning that only those peaks above this threshold will be focused for a charge state analysis in the second algorithm). An optional dynamic S/N threshold allows increasing the threshold in peak-dense regions containing multiple adjacent/overlapping IDs in order to limit the running time.

The present invention represents a holistic approach to the determination of monoisotopic masses of peaks or a parameter correlated the mass of the isotopes of the isotope distribution of at least one species of molecules in a mass spectrum, suitable for a broad range of applications/chemical species, but with a focus on intact proteins and multiply charged species bearing high charge states. An essential element is the speed optimization of the method, which ensures its applicability for an online detection within ~20-30 milliseconds of the majority of the species contained in a mass spectrum of a complex protein sample.

The method is capable of handling unresolved isotope distributions, so that even low-resolution spectra of complex protein samples can be used in the inventive method.

DETAILED DESCRIPTION OF PREFERRED EMBODIMENTS

Figure 14:
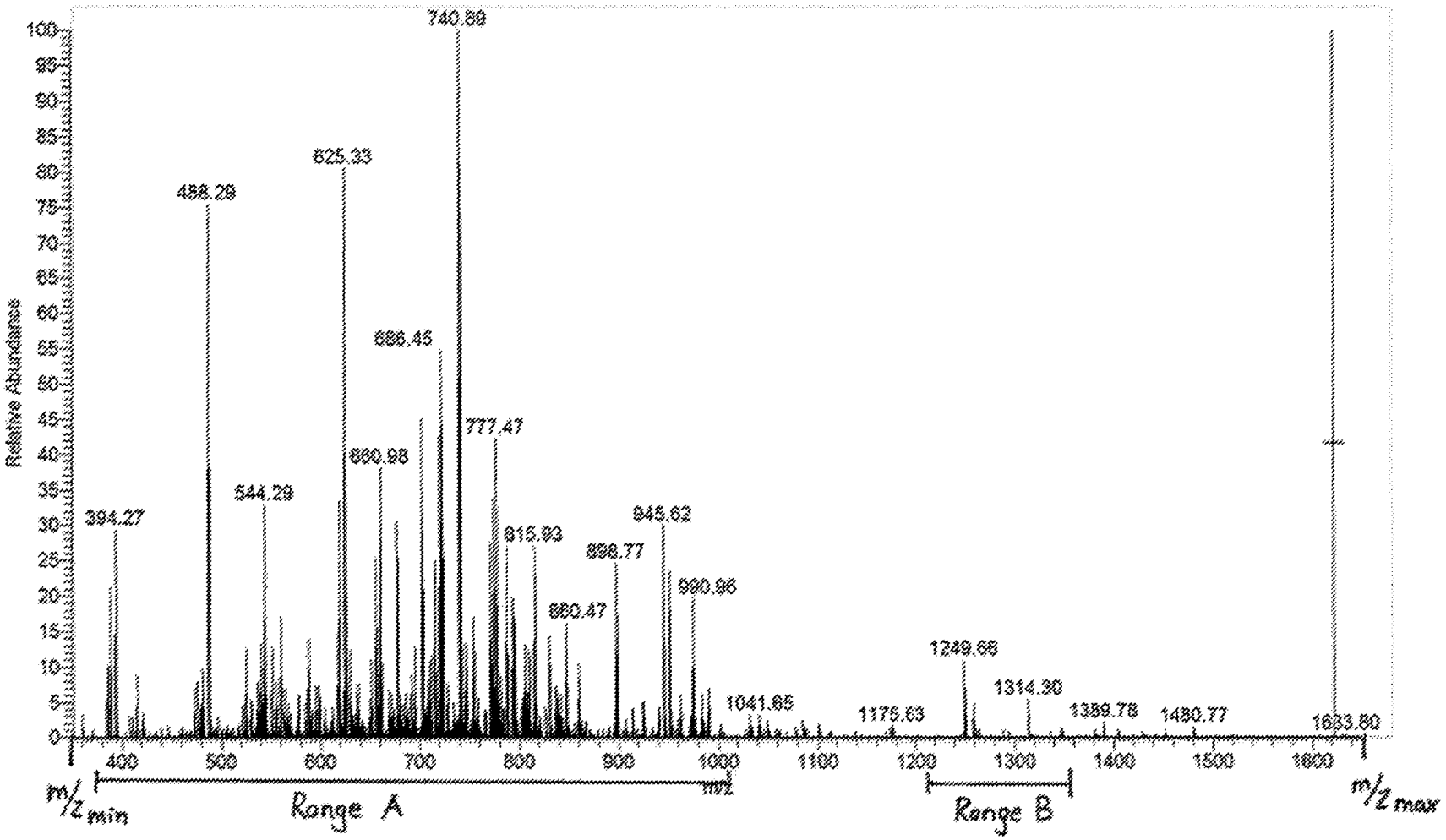
FIG. 14 is a depiction of a mass spectrum and of ranges of m/z values investigated by an alternative method for identification of the monoisotopic mass of species of molecules, as described in the appendix.

FIG. 14 shows a mass spectrum and ranges of m/z values investigated by the method described in this appendix. The method of invention is used to identify at least the monoisotopic mass of one species of molecules, mostly various species of molecules. Preferably the method is used to identify the monoisotopic mass of large molecules like peptides, proteins, nucleic acids, lipids and carbohydrates basing typically a mass of typically between 200 u and 5,000,000 u. preferably between 500u and 100,000 u and particularly preferably between 5,000 u and 50,000 u.

The method of the invention is used to investigate samples. These samples may contain species of molecules which can be identified by their monoisotopic mass or a parameter correlated the mass of the isotopes of their isotope distribution.

In the following the embodiments of the inventive method are only described to identify the monoisotopic mass of species of molecules. Nevertheless all the described methods can be also used to identify a parameter correlated the mass of the isotopes of the isotope distribution of species of molecules. In particular this parameter the average mass of the isotopes of the isotope distribution of a species of molecules, the mass of the isotope with the highest occurrence in the isotope distribution of a species of molecules and the mass of the centroid of the isotope distribution of a species of molecules.

A species of molecules is defined as a class of molecules having the same molecular formula (e.g. water has the molecular formula $H_2O$ and methane the molecular formula $CH_4$.)

Or the investigated sample can be better understood by ions which are generated from the sample by at least an ionisation process. The ions may be preferably generated by electrospray ionisation (ESI), matrix-assisted laser desorption ionisation (MALDI), plasma ionisation, electron ionisation (EI), chemical ionisation (CI) and atmospheric pressure chemical ionization (APCI). The generated ions are charged particles mostly having a molecular geometry and a corresponding molecular formula. In the context of this patent application the term "species of molecules originated from a sample by at least an ionisation process" shall be understood is referring to the molecular formula of an ion which is originated from a sample by at least an ionisation process.

So monoisotopic mass or a parameter correlated the mass of the isotopes of the isotope distribution of a species of molecules originated from a sample by at least an ionisation process can be deduced from the ion which is originated from a sample by at least an ionisation process by looking for the molecular formula of the ion after the charge of the ion has been reduced to zero and changing the molecular formula accordingly to the ionisation process as described below.

In the species of molecules all molecules have the same composition of atoms according to the molecular formula. But each atom of the molecule can occur as different isotopes. So the basic element of the organic chemistry, the carbon atom occurs in two stable isotopes, the $^{12}C$ isotope with a natural propability of occurrence of 98.0 % and the $^{13}C$ isotope (having one more neutron in its atomic nucleus) with a natural propability of occurrence of 1.1%. Due to this probability of occurrence of the isotope particularly complex molecules of higher mass consisting of a higher number of atoms have a lot of isotopes. These isotopes base different masses resulting in a mass distribution of the isotopes, named in the content of this patent application isotope distribution (short term: ID) of the species of molecules. Each species of molecules therefore can has e different masses but for a better understanding and identification of a species of molecules to each molecule is assigned a monoisotopic mass. This is the mass of a molecule when each atom of the molecule exists as the isotope with the lowest mass. For example a methane molecule has the molecular formula $CH_4$ and hydrogen has the isotopes $^1H$ having on a proton in his nucleus and $^2H$ (deuterium) having an additional neutron in his nucleus. So the isotope of the lowest mass of carbon is $^{12}C$ and the isotope of the lowest mass of hydrogen is $^1H$. Accordingly the monoisotopic mass of methane is 16 u. But there is a small propability of other methane isotopes having the masses 17 u, 18 u, 19 u, 20 u and 21 u. All these other isotopes belong to the isotope distribution of methane and can be visable in the mass spectrum of a mass spectrometer.

In the first step or the inventive method a mass spectrum of the sample has to be measured by a mass spectrometer. In general every kind of mass spectrometer can be used known to a person skilled in the art to measure a mass spectrum of a sample. In particular it is preferred to use a mass spectrometer of high resolution like a mass spectrometer having an Orbitrap as mass analyser, a FT-mass spectrometer, an ICR mass spectrometer or an MR-TOF mass spectrometer. Other mass spectrometers for which the inventive method can be applied are particularly TOF mass spectrometer and mass spectrometer with a HR quadrupole mass analyser But the inventive method has also the advantage that it is able to identify the monoisotopic mass of species of molecules if the mass spectrum is measured with a mass spectrometer having a low resolution so that for example the neighbouring peaks of isotopes having a mass difference of 1 u cannot be distinguished.

On the one hand molecules already present in the sample are set free and are only charged by the ionisation process e.g. by the reception and/or emission of electrons, protons ($H^+$) and charged particles. The method of the invention is able to assign to these species of molecules contained in the sample its monoisotopic mass due to their ions which are detected in the mass spectrum of the mass spectrometer.

On the other hand the ionisation process can change the molecules contained in the sample by fragmentation to smaller charged particles or addition of atoms or molecules to the molecules contained in the sample resulting in larger molecules which are charged due to the process. Also by an ionisation process the matrix of a sample can be splitted in molecules which are charged or clusters of molecules can be build. So all these ions are originated from the sample by a described ionisation process. So for these ions the accordingly species of the molecules originated from the sample can be investigated by the inventive method and the method may be able to identify their monoisotopic mass.

In a next possible step of the inventive method at least a mass range of the measured mass spectrum is divided in fractions. This step can be for example executed by a processor being a part of the mass spectrometer which may have additional other functions like to control the mass spectrometer. It is the object of the partition of the mass range that each fraction can be assigned to one processor of several processors provided by a multiprocessor having several central processor units (CPU) which then can in a single thread deduce in the assigned fraction of the mass range isotope distributions of ions of species of molecules having a specific charge z. Typically a multiprocessor has 2 or 4 CPU's to deduce in fractions assigned to the specific CPU isotope distributions of ions of species of molecules having a specific charge z. But still more CPU's e.g. 6 , 8 or 12 can be used for the deduction of the isotope distributions. If more CPU's are used accordingly for more fractions the isotope distributions of ions of species of molecules having a specific charge z can be deduced in parallel.

After the measurement of a mass spectrum of a sample by the mass spectrometer it has to be defined which ranges of m/z values detected by the measurement shall be used to identity the monoisotopic masses of species of molecules contained in a sample and/or originated from the sample by at least the ionisation process during their ionisation in the mass spectrometer. The used ranges of detected m/z values can be defined by the user. He can define the ranges before the measurement of the mass spectrum is started or after is mass spectrum is shown on a graphical output system like a display. The ranges can be defined based on the intention of investigation of the sample and/or based on the resulting mass spectrum. So if in a range of m/z values no peaks are observed, this range of the m/z values can be suspended from further evaluation and do not belong to the range of M/Z values divided in fractions.

The used ranges of detected m/z values can be defined by also by a controller who is controlling the method of identification. For example if a measured mass spectrum in a range of m/z values no peaks or no peaks having an intensity higher than a threshold value are observed, this range of the m/z values can be suspended from further evaluation by the controller restricting the ranges of m/z values used to identify the monoisotopic masses.

In one embodiment of the inventive method the whole range of m/z values detected by the mass spectrometer and therefore shown in the measured mass spectrum is divided in fractions used to deduce isotope distributions.

Figure 1A:
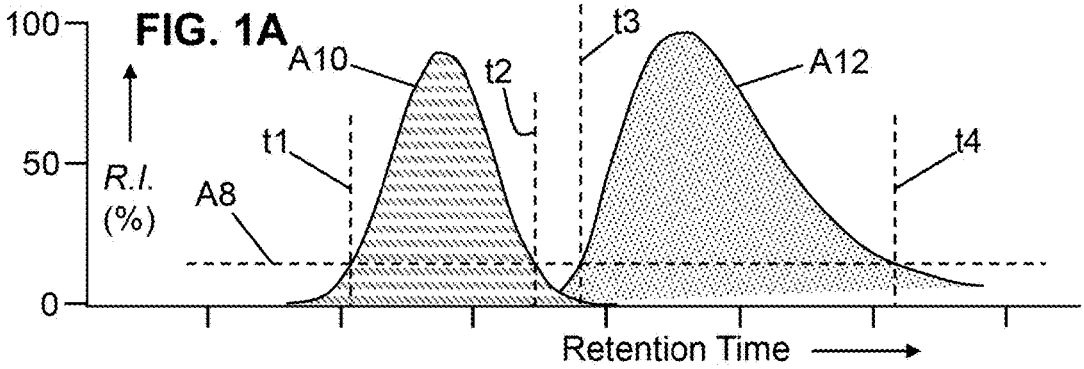
FIG. 1A is a schematic illustration of analysis of two analyte tractions exhibiting well-resolved chromatographic elution peaks.
Figure 1B:
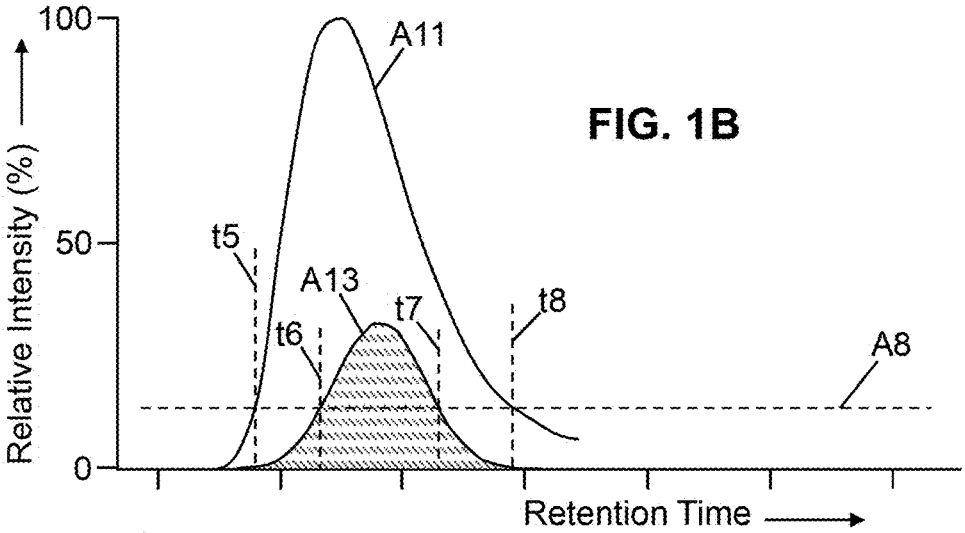
FIG. 1B is a schematic illustration of a portion of a chromatogram with highly overlapping elution peaks, both of which are above an analytical threshold.
Figure 1C:
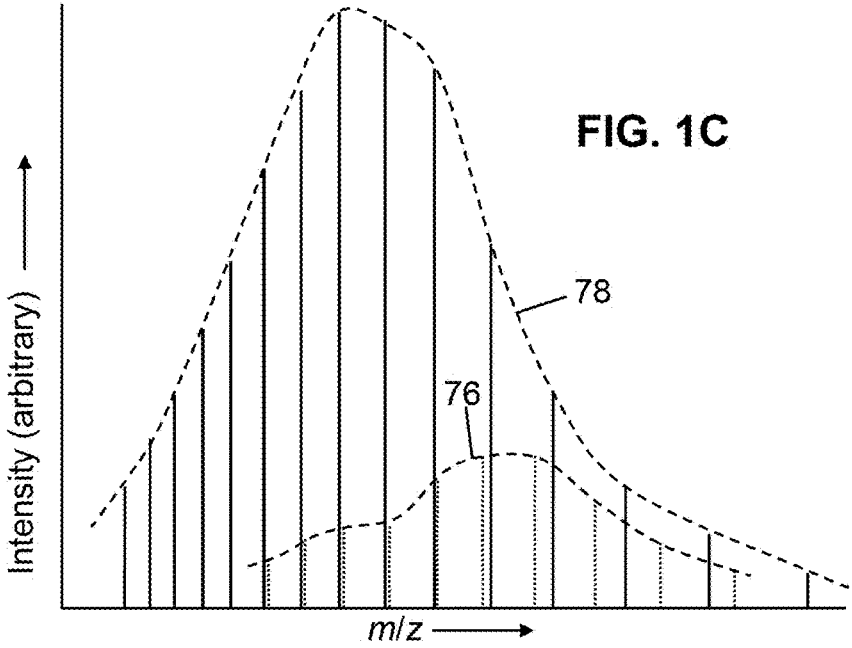
FIG. 1C is an illustration of multiple interleaved mass spectral peaks of two simultaneously eluting biopolymer analytes.
Figure 2:
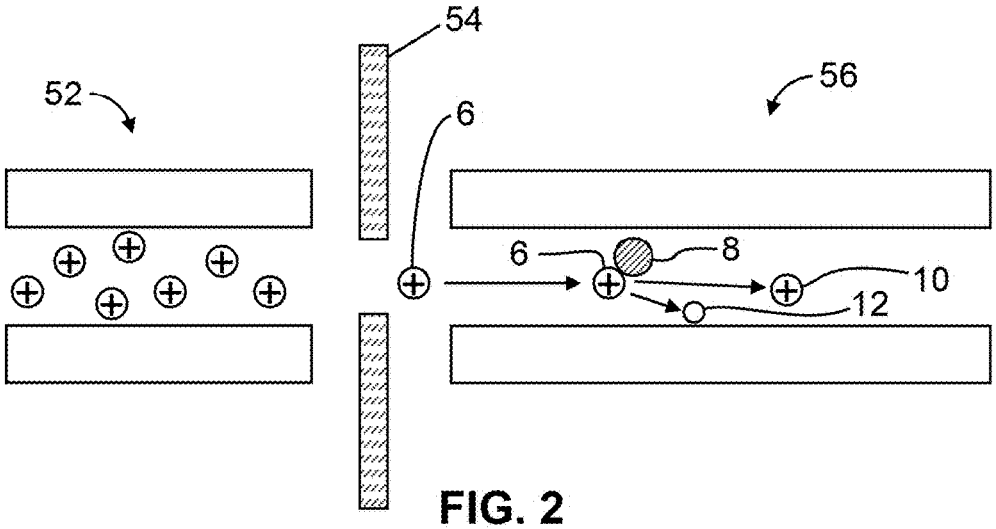
FIG. 2 (Prior Art)
FIG. 2 is a schematic illustration of a conventional apparatus and method for fragmenting ions by collision-induced dissociation.
Figure 4B:
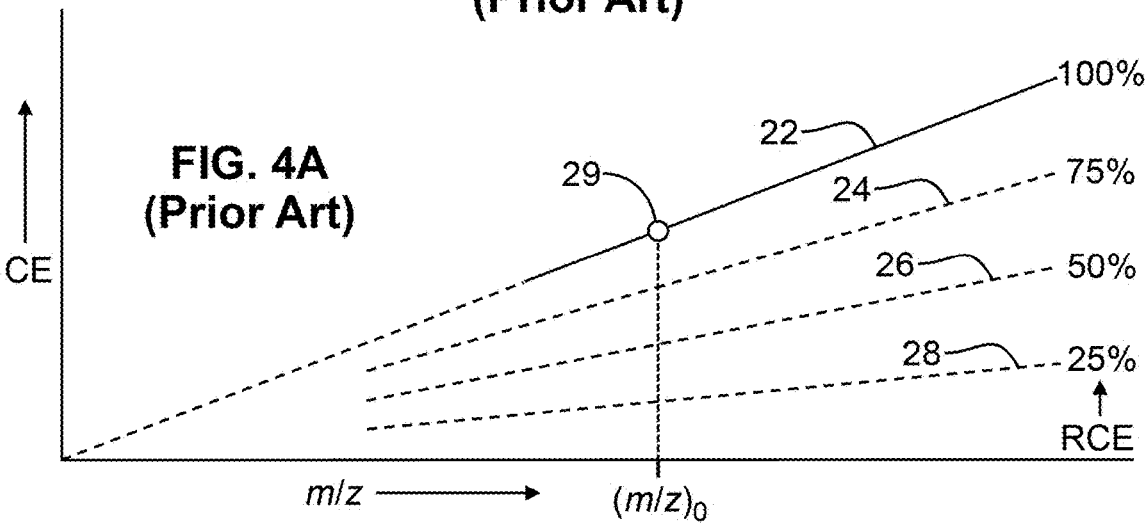
FIG. 4B (Prior Art)
FIG. 4B is a table illustrating correction factors that are applied to the known normalized collision energy operational technique to compensate for the effect of precursor ion charge state on the extent of fragmentation produced by collisional induced dissociation.
Figure 3A:
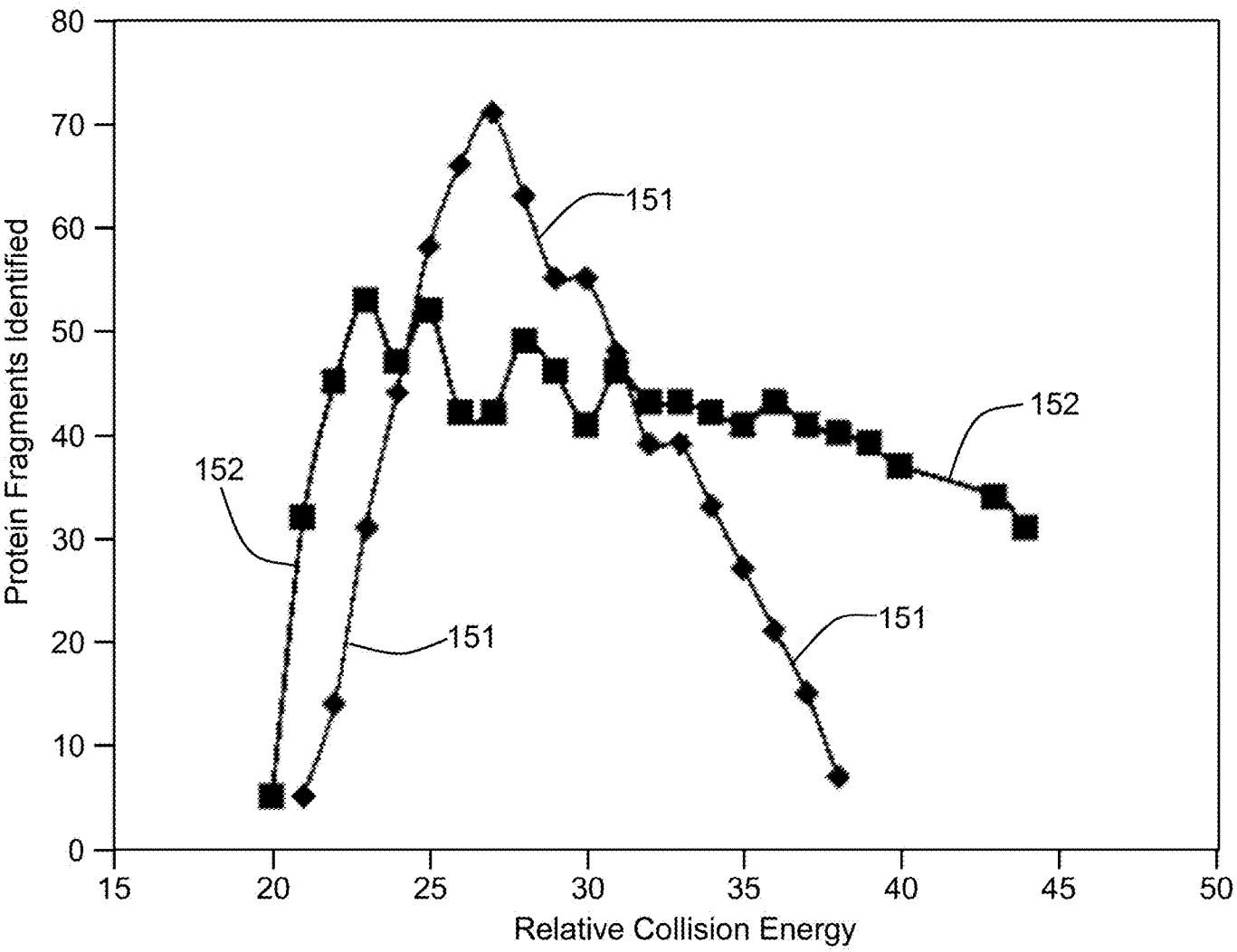
FIG. 3A is a general graphical comparison between the effect of increasing energy on the number of identifiable protein fragment ions generated by HCD fragmentation and the effect of increasing energy on the number of such identifiable ions generated by RE-CID fragmentation.
Figure 3B:
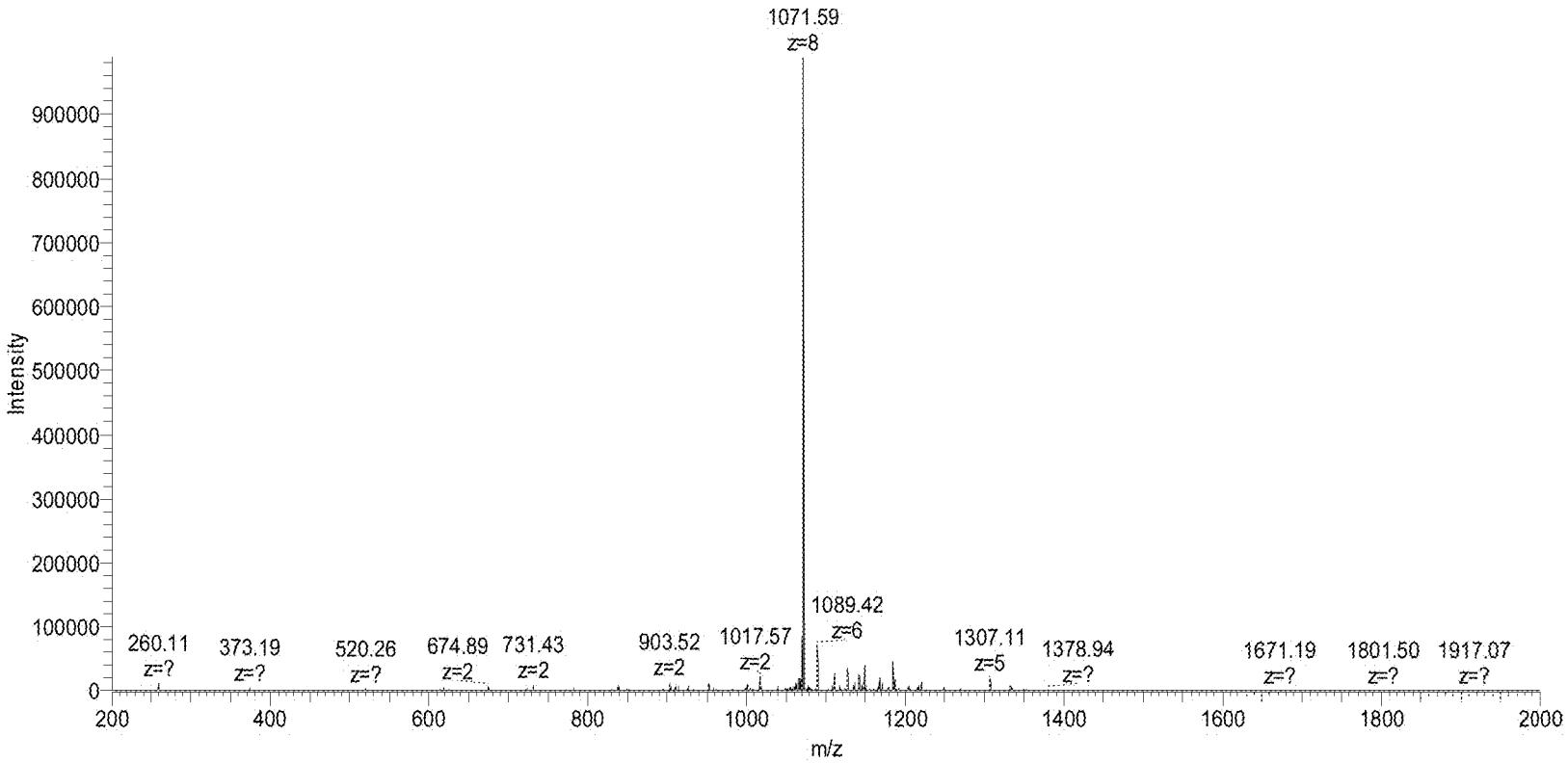
FIGS. 3B, 3C and 3D are mass spectra of fragment ions generated by HCD fragmentation of the +8 charge state precursor ion from the protein ubiquitin, using relative collision energy settings of 25, 30 and 40, respectively.
Figure 3C:
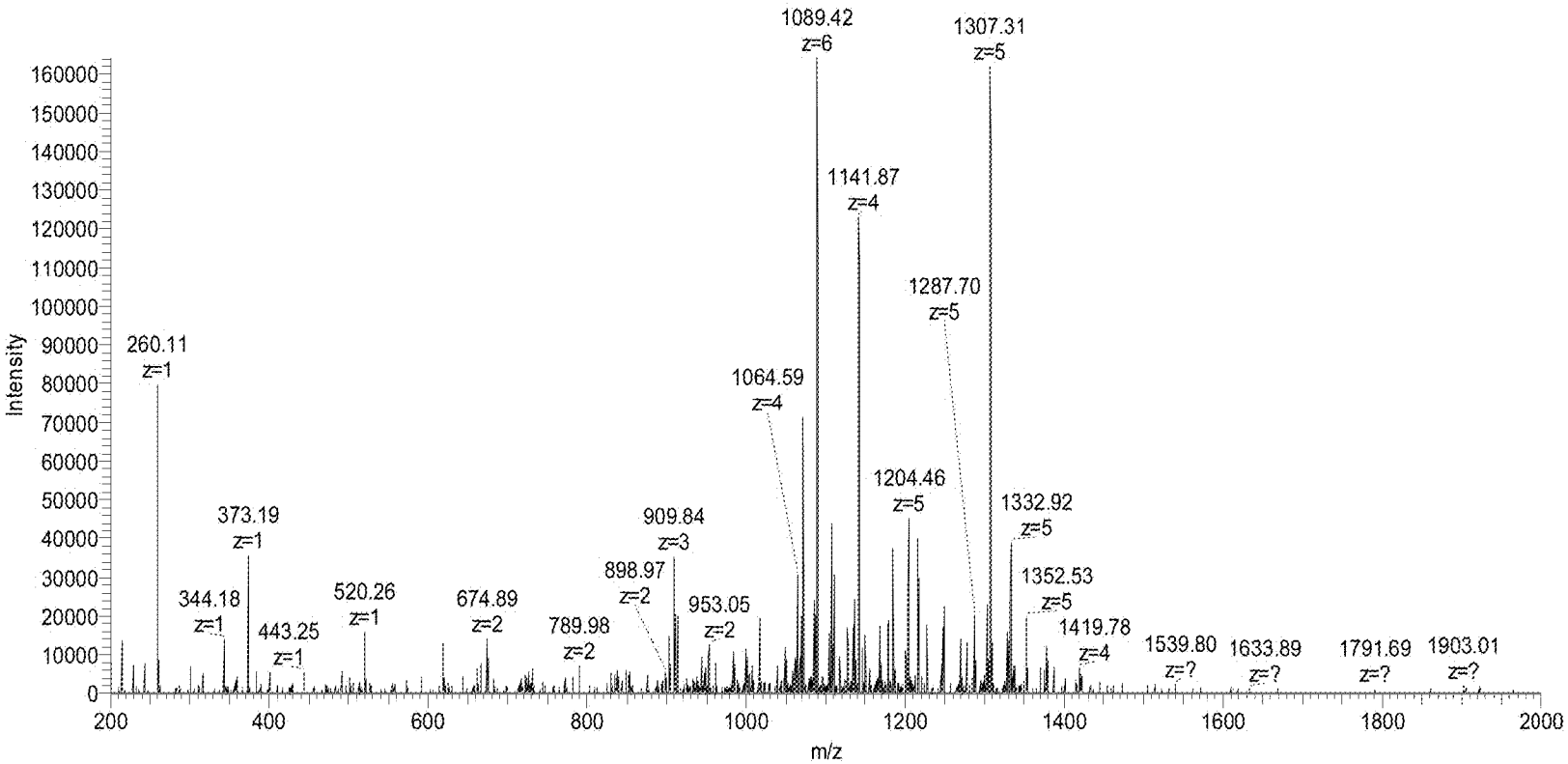
Figure 3D:
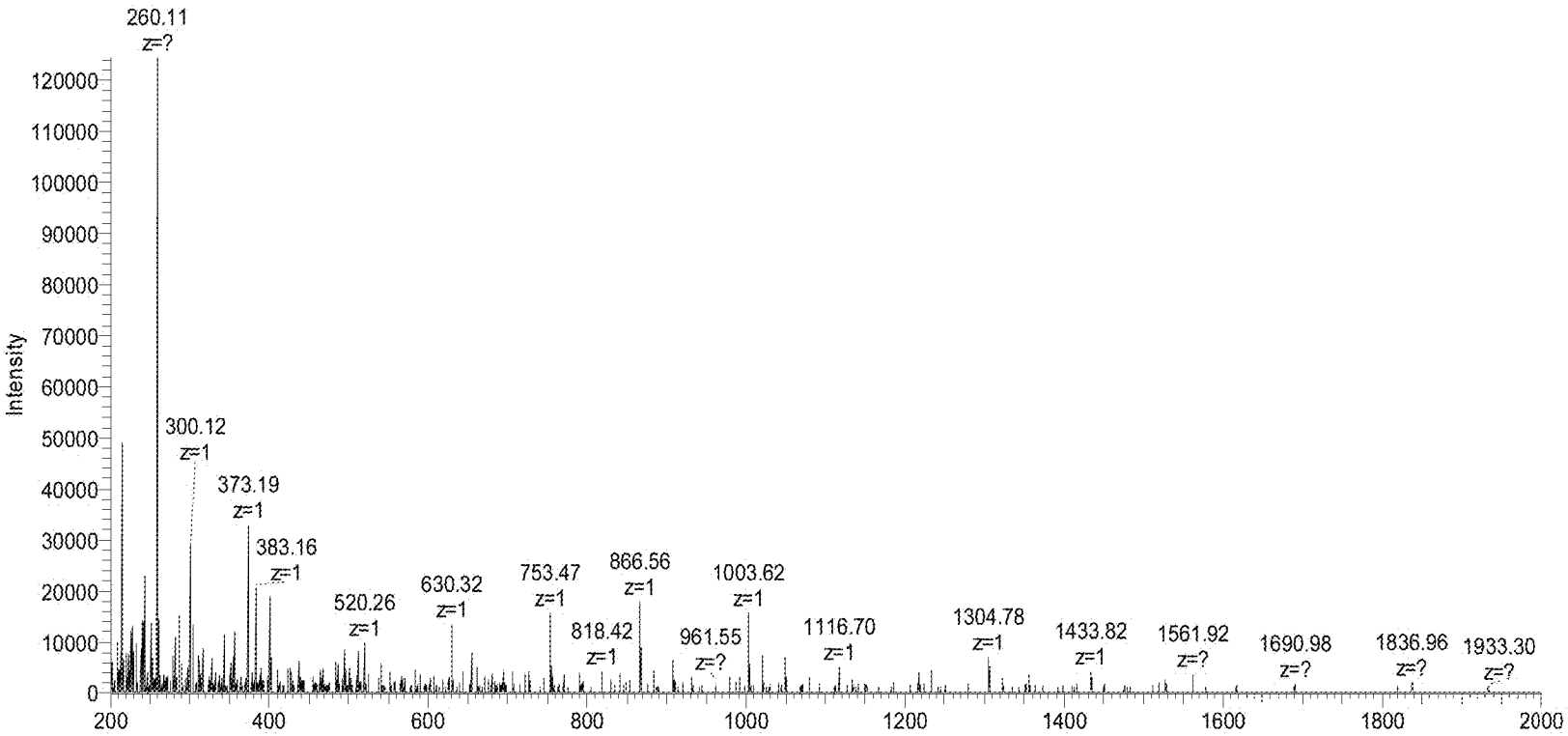

This is shown in FIG. 1 showing a mass spectrum measured by a mass spectrometer. The mass spectrometer was detecting ions having a m/z value (ratio of ion mass m and ion charge z) between a minimum value $m/z_{min}$ and a maximum value $m/z_{max}$. This whole range of m/z values between a minimum value $m/z_{min}$ and a maximum value $m/z_{max}$ can then be divided in gractions which are then assigned to discrete processors (CPU) to deduce isotope distributions of ions of species of molecules contained in the sample and/or originated from the sample by at least an ionisation process having a specific charge z.

In another embodiment of the inventive method not the whole range of m/z values detected by the mass spectrometer and therefore shown in the measured mass spectrum is divided in fractions used to deduce isotope distributions. In this embodiment only one or more specific ranges of the m/z value of the mass spectrum detected by the mass spectrometer are divided in fractions used to deduce isotope distributions.

This is also shown in FIG. 1 showing a mass spectrum measured by a mass spectrometer. The mass spectrometer was detecting ions having a m/z value (ratio of ion mass m and ion charge z) between a minimum value $m/z_{min}$ and a maximum value $m/z_{max}$. But it is also possible that not the whole range of m/z values between a minimum value $m/z_{min}$ and a maximum value $m/z_{max}$ is divided in fractions which are then assigned to discrete processors (CPU) to deduce isotope distributions of ions of species of molecules contained in the sample and/or originated from the sample by at least an ionisation process having a specific charge z. It is also possible that specific ranges of measured m/z values are divided in fractions which are then assigned to discrete processors (CPU) to deduce isotope distributions. In FIG. 1 it is shown the range A and the range B of the m/z values. In one embodiment only the range A of measured m/z values is divided in fractions which are then assigned to discrete processors (CPU) to deduce isotope distributions. In another embodiment only the range B of measured m/z values is divided in fractions which are then assigned to discrete processors (CPU) to deduce isotope distributions. In a further embodiment both ranges, the range A of measured m/z values and the range B of measured m/z values are divided in fractions which are then assigned to discrete processors (CPU) to deduce isotope distributions. According to FIG. 1 in this embodiment only those ranges, the ranges A and B, are divided in fractions and used for the deduction of isotope distributions, which in which peaks have been measured of a relative abundance of more than 5%.

At the beginning the at least one range of measured m/z values is divided in a fractions of a specific window width $\Delta m/z_{start}$. Typically the window width $\Delta m/z_{start}$ is slightly larger than 1 Th (Thompson, 1 Th=1 u/e; u: atomic mass unit; e: elementary charge; 1 u=1.660539* $10^{-27}$ Kg; 1 e=1,602176*$10^{-19}$ C). In preferred embodiments the window width $\Delta m/z_{start}$ is between 1.000 Th and 1.100 Th, in a more preferred embodiments the window width $\Delta m/z_{start}$ is between 1.005 Th and 1.050 Th and in a particularly preferred embodiments the window width $\Delta m/z_{start}$ between Th 10 Th and 1.020 Th. The window width $\Delta m/z_{start}$ is chosen in the range of 1 Th, because at the lowest charge state of an ion the charge is z=1 and therefore the smallest distance between the m/z values of neighbouring isotopes is 1 Th. This takes securely into account some technical tolerances the window width $\Delta m/z_{start}$ has to be choosen slightly larger than 1 Th. The technical tolerances are originated e.g. by deviation due to chemical elements, peak widths, the centroidisation of m/z peaks.

All of these tractions with the starting window width $\Delta m/z_{start}$ are investigated if they have a significant peak. Only fractions with such a peak are assigned to a processor which will then deduce an isotope distribution from the measured mass spectrum in the range of the fraction of the at least one range of measured m/z values. Mostly the investigation if a fraction with the starting window width $\Delta m/z_{start}$ has a significant peak is started at one boundary of the at least one range of measured m/z values which shall be divided, the highest m/z value or the lowest m/z value. A fraction has significant peak if the peak of the most intensity of the fraction has a signal to noise ratio S/N which is higher than a threshold value T.

After a fraction with the starting window width $\Delta m/z_{start}$ has been investigated if it has a significant peak, the neighbouring fraction with the starting window width $\Delta m/z_{start}$ not investigated before will be investigated if it has a significant peak. Neighbouring fractions are concatenated to build a fraction of the larger window width $\Delta m/z$ if both fractions comprise isotopes of the same isotope distribution of ions of a species of molecules of a specific charge or isotopes of contiguous isotope distributions or overlapping isotope distributions. Therefore two neighbouring fractions are not concatenated if one of them has no significant peak.

If the investigation if a fraction with the starting window width $\Delta m/z_{start}$ has a significant peak is started at one boundary of the at least one range of measured m/z values which shall be divided the investigation ends with that neighbouring fraction not investigated before which comprises the second boundary of the at least one range of measured m/z values which shall be divided. If only one range of measured m/z values shall be divided into fractions then the whole investigation of the fractions is finished. If not only one range of measured m/z values shall be divided into fractions then the next next range of measured m/z values which shall be divided which has not already divided in fractions is divided into fractions in the same way or with different parameters. The dividing into fractions is finished after all ranges of measured m/z ranges which have been defined to be divided have been divided in fractious.

The concatenation of fractions of the starting window width $\Delta m/z_{start}$ may be limited to specific number of such tractions. Due to this too long operation time of a single processor to deduce isotope distributions in an assigned concatenated fractions can be avoided which would increase the whole time to execute the inventive method. In a preferred embodiment of the inventive method not more than 20 fractions of the starting window width $\Delta m/z_{start}$ should be concatenated, in a more preferred embodiment of the inventive method not more than 12 fractions of the starting window width $\Delta m/z_{start}$ and in a particular preferred embodiment of the inventive method not more than 8 fractions of the starting window width $\Delta m/z_{start}$.

In an embodiment of the inventive method the threshold value T defining if a fraction has a significant peak is for all investigated fractions the same. Usually threshold values T in the range of 2.0 to 5.0 are used, preferably in the range of 2.5 to 4.0 and particularly preferably in the range of 2.8 to 3.5.

In another embodiment the threshold value T is dynamically adjusted. In one preferred embodiment it is changed depending on the peak density of the fractions. Then the threshold value T is increased if fractions base a high number of significant peaks N to limit the number of peaks N from which isotope distributions are deduced by the processors. Therefore number of peaks N having a signal to noise ratio S/N which is higher than a threshold value T is limited in each fraction. Such a fraction can be concatenated of fractions having the starting window width $\Delta m/z_{start}$. The number of significant peaks N in a fraction is limited by a limit $N_{max}$. This can be set by the user, the controller or the producer of the controller by hardware or software. Typically is in the range of 100 to 500, preferably in the range of 180 to 400 and particularly preferably in the range of 230 to 300. At the beginning there is set an initial threshold value $T_i$. Usually the initial threshold value $T_i$ is set in the range of 2.0 to 5.0, preferably in the range of 2.5 to 4.0 and particularly preferably in the range of 2.8 to 3.5. If the number of significant peaks N having a signal to noise ratio S/N which is higher than a threshold value T is higher than the limit $N_{max}$ in a fraction, the threshold T is increased by a factor and then the fraction is investigated again regarding the number of significant peaks N having a signal to noise ratio S/N which is higher than a threshold value T. In increase of the threshold is repeated up to the number of peaks having a signal to noise ratio S/N which is higher than a threshold value T is below the limit $N_{max}$. Typically the threshold T is increased with a the factor between 1.10 and 2.50. Preferably the threshold T is increased with a the factor between 1.25 and 1.80. Particular preferably the threshold T is increased with a the factor between 1.35 and 1.6. The increase of the threshold T is limited by a maximum value $T_{max}$ of the threshold. By this limit it shall be avoided that significant peaks of the sample will be ignored. The maximum value of the threshold $T_{max}$ can be set by the user, the controller or the producer of the controller by hardware or software. Typically the maximum value of the threshold $T_{max}$ is set between 6 and 40. Preferably the maximum value of the threshold $T_{max}$ is set between 10 and 30. Particular preferably the maximum value of the threshold $T_{max}$ is set between 12 and 20.

If for a number of fractions, which may be fractions with the starting window width $\Delta m/z_{start}$ or fraction of the larger window width $\Delta m/z$ concatenated from fractions with the starting window width $\Delta m/z_{start}$, are investigated one after the other, the threshold T has not been increased for these fractions and the threshold of the fractions is higher than the initial threshold $T_i$ then the threshold T of the following neighbouring fractions will be decreased, preferably successively, down to the initial threshold $T_i$. This decrease of the threshold T with may be done by subtracting a specific value or by reducing the threshold T by a factor. Typically the specific value substrated is between 0.10 and 0.70. preferably between 0.15 and 0.40 and particularly preferably between 0.20 and 0.30. The factor reducing the threshold T is typically between 0,85 and 0.99, preferably between 0.92 and 0.97 and particularly preferably between 0.05 and 0.96. it is also possible to use both methods to decrease the threshold T at the same time and to use the higher or lower decreased value of the threshold T following neighbouring fraction. A decrease of the threshold below the initial threshold $T_i$ should not be done. If this would happen the following neighbouring tractions should be investigated using the initial, threshold $T_i$.

If a fraction with the starting window width $\Delta m/z_{start}$ has been investigated with a threshold value T which is higher than the initial threshold $T_i$ and this fraction has no significant peak, in one embodiment of the inventive method then the investigation is executed again with the initial threshold $T_i$. If then a significant peak has been observed for the fraction, this fraction is marked to be a fraction with a low signal to noise ratio S/N.

In further possible step of the inventive method at least some of the fractions of the at least one range of measured m/z values are assigned to a processor. The processor is one processor of several processors provided by a multiprocessor having several central processor units (CPU). The processor can in a single thread deduce in the assigned fraction of the mass range isotope distributions of ions of species of molecules having a specific charge z. Typically a multiprocessor has 2 or 4 CPU's to deduce in fractions assigned to the specific CPU isotope distributions of ions of species of molecules having a specific charge z. But still more CPU's e.g. 6, 8 or 12 can be used for the deduction of the isotope distributions. If more CPU's are used accordingly for more fractions the isotope distributions of ions of species of molecules having a specific charge z can be deduced in parallel. The processors of the multiprocessor can be physically located at one place. Then the multiprocessor can be part of the mass spectrometer. The multiprocessor can be also used for other functions of the mass spectrometer like controlling functions of the mass spectrometer known to a person skilled of the art. The multiprocessor physically located at one place can be separated from the mass spectrometer and for example just recessing files of the measured mass spectrum for the mass spectrometer. Also the various multiprocessors cant be located at different places and may be communicating with the mass spectrometer for example with a control unit of the mass spectrometer.

This step of assigning at least some of the fractions of the at least one range of measured m/z values to a processor can be for example executed by a processor being a part of the mass spectrometer which may have additional other functions like to control the mass spectrometer.

In a preferred embodiment of the inventive method only fractions having a significant peak are assigned to a processor. These fractions can have on the one band the starting window width $\Delta m/z_{start}$. On the other hand these fraction can have a larger window width $\Delta m/z$ because they are build from concatenated neighbouring fractions.

In another preferred embodiment of the inventive method only fractions having a significant peak and fractions marked to be a fraction with a low signal to noise ratio S/N are assigned to a processor.

In a preferred embodiment of the invention to each processor $P_i$ of the multiprocessor used to deduce isotope distributions of ions of species of molecules having a specific charge z from the measured mass spectrum in assigned fractions of the at least one range of measured m/z values the assignment is assigned a peak counter $C_i$ and list in which information regarding the assigned fraction is stored. The peak counter $C_i$ the number of significant peaks N of each fraction assigned to the processor $P_i$ is counted by the addition of the number of significant peaks N of all assigned fractions. The number of significant peaks N is investigated for each fraction when dividing the at least one range of measured m/z values in fractions to assess if the the number of significant peaks N exceed the limited number of significant peaks $N_{max}$.

The fractions having a significant peak or the tractions having a significant peak and fractions marked to be a fraction with a low signal to noise ratio S/N are assigned one after the offset to the processors $P_i$. The next fraction to be assigned to a processor is always assigned to that processor whose up to that moment assigned fractions have lowest number of significant peaks in total. That means that the next fraction to be assigned to a processor is always assigned to that processor $P_i$ whose peak counter $C_i$ is the lowest. The number of the significant peaks of that assigned fraction is added to the peak counter $C_i$. So always to that processor to which the lowest number of significant peaks is assigned the next fraction basing significant peaks is assigned. With this assignment if is ensured that the number of significant peaks in the assigned fractions is even distributed across the processors. This ensures that the deducing of isotope distributions from the fractious assigned to the processors takes for every processor nearly the same time. With this assignment a fast deducing of isotope distributions by the several provided precessors is achieved.

The steps of dividing at least one range of measured m/z values of the mass spectrum of the sample into fractions and assigning at least some of the fractions of the at least one range of measured m/z values to one processor of several provided processors can be done successive or parallel. If the steps are executed in parallel then each fraction defined in the step of dividing at least one range of measured m/z values of the mass spectrum of the sample into fractions is immediately after its definition assigned to the processor who will deduce the isotope distributions for this fraction.

In a next step of the inventive method an isotope distribution of ions of a species of molecules having a specific charge z is deduced from the measured mass spectrum in at least one of the fractions of the at least one range of m/z values. The deduced isotope distribution of ions having a specific charge z is deduced for ions of a species of molecules contained in the sample or for ions originated from the sample by at least an ionisation process. Preferably for several ions of a species of molecules contained in the sample or/and originated from the sample by at least an ionisation process an isotope distribution of the ions having a specific charge z can be deduced.

In one embodiment of the inventive method in each of the fractions of at least one range of measured m/z values at least one isotope distribution of ions of one species of molecules having a specific charge z is detected.

It is possible that not for all specifies of molecules for which a isotope distribution of their ions having a specific charge z is deduced the monoisotopic mass will be deduced by the inventive method.

In the following is described how in one fraction of the at least one range of measured m/z values which is assigned to one processor isotope distributions of ions of a species of molecules having a specific charge z are deduced from the measured mass spectrum according to a preferred embodiment of the inventive method. Preferably only peaks are used which have been identified as significant peaks before as described above.

At first the peak of highest intensity in investigated fraction of measured m/z values is defined. Then the maximum charge state $z_{max}$ which can be assigned to this peak of highest intensity has to be defined. Therefore the closest peaks adjacent to the peak of highest intensity have to be identified. The should an intensity which is not below a relative intensity value compared to the peak of highest intensity (typical 2% to 6% of the intensity of the peak of highest intensity preferably 3% to 5% and particularly preferably 4%). Also preferably the distance of these peaks should not be larger than the starting window width $\Delta m/z_{start}$. From the distance d between the peak of highest intensity and the closest peak adjacent to the peak of highest intensity a possible maximum charge state $z_{max}$ can be assumed taking us to account the mean isotope mass difference distance $\Delta m_{ave}$ according to a avergine distribution (described e.g. by Senko et al J. J. Am. Mass Spectrom. 1995, 6, 229-233 and Valkenborg et al. J. Am. Mass Spectrom. 2008, 19, 703-712)

$$z_{max} = \frac{\Delta m_{ave}}{d}$$

Typically values for the mean isotope mass difference distance $\Delta m_{ave}$ are in the range of 1.0020 u to 1.0030 and preferably between 1.0023 and 1.0025 u. Particular preferably the value 1.00235 is used as the mean isotope mass difference distance $\Delta m_{ave}$.

Preferably the so evaluated maximum charge state $z_{max}$ can be further increased by a factor larger than 1. Due to this it shall be secured that at least one higher charge state is investigated. Typically the factor with which the evaluated maximum charge state is multiplied is in the range of 1.10 and 1.30, preferably in the range of 1.125 and 1.20. Preferably the so achieved is round up to next next natural number, i.e. positive integer.

Preferably the maximum charge state $z_{max}$ can be limited to maximum value. This can depend on the type of the sample which is investigated by the inventive method. So if intact proteins are investigated the maximum charge state $z_{max}$ is preferably limited to values between 50 and 60 and if peptieds are investigated the maximum charge state $z_{max}$ is preferably limited to values below 20. A reasonable choice of the limit of the maximum charge state $z_{max}$ avoids the investigation of unrealistic charge states and reduces therefor the time to deduce the isotope distributions. The limit of the maximum charge state $z_{max}$ can be set by the user, the controller or the producer of the controller by hardware or software. Preferably the limit of the maximum charge state $z_{max}$, if set by the controller or the producer of the controller by hardware or software is set according to an information of the user, which kind of sample shall be investigated.

After the value of the maximum charge state $z_{max}$ has been defined for the investigated peak of highest intensity P1 in the investigated fraction of measured m/z values for each charge state z between the charge 1 and the maximum charge state $z_{max}$ a score value, the charge score $cs_{P1}(z)$ is evaluated from mass spectrum in the investigated fraction of measured m/z values. The charge score $cs_{PX}(z)$ of a measured peak PX (X=1, . . . , N) in general reflects to propability that the measured peak PX. belongs to an isotope distribution with the charge z.

In a preferred embodiment of the inventive method the charge score $cs_{PX}(z)$ of a measured peak PX assumed as the peak of an isotope distribution of the highest intensity in the following mode:

Based on an avergine model at first it is defined how much peaks $N_{left_PX}(z)$ of an istope distribution can be expected for the peak PX having smaller m/z values and how much peaks $N_{right_PX}(z)$ of an isotope distribution can be expected for the peak PX having higher m/z values. Preferably only those peaks of the isotope distribution are taken into account which have an intensity, which is not smaller than an percentage of the intensity of the highest peak PX of the investigated isotope distribution, the cutoff intensity. Typically this cutoff intensity is in the range of 0.5 to 6% of the intensity of the highest peak PX, preferably in the range of 0.8 to 4% of the intensity of the highest peak PX. Particular the cutoff intensity is 1% of the intensity of the highest peak PX.

For example the number of peaks $N_{left_PX}(z)$ having a smaller m/z value and the number of peaks $N_{right_PX}(z)$ having a larger m/z value can be calculated by the formulas:

$$V_{left_PX}(z) = A * \sqrt{\frac{m}{z}(PX) * z} - B$$

$$V_{right_{PX}}(z) = C * \sqrt{\frac{m}{z}(PX) * z} + D$$

The value m/z(PX) is the m/z value of the measured peak PX. The constants A,B,C and D are given by the used avergine model. Typical values are: 0.075<A<0.080, 2.35<B<2.40, 0.075<C<0.080, 0.80<D<0.85.

Hereby is $N_{left_PX}(z)$ is first positive integer smaller than the value $V_{left_PX}(z)$ or otherwise 0 and $N_{right_PX}(z)$ is the integer most closely to the value $V_{right_PX}(z)$.

Then for all peaks of the isotope distribution assigned to the peak PX and the charge z the according theoretical m/z values are defined.

If a mean isotope mass difference Δm is assumed for the isotope distribution, the peaks of the isotope distribution have the theoretical m/z values:

$$m/z(z)_k = m/z(PX) + k * \Delta m/z$$

$$\text{with } k = (-N_{left_PX}(z), \ldots, N_{right_PX}(z) - 2, N_{right_PX}(z) - 1, N_{right_PX}(z))$$

So for example if $N_{left_PX}(z)=1$, that means there is one peak in the isotope distribution of the charge z on the left side of the peak PX and $N_{right_PX}(z)=6$, that means there are six peak in the isotope distribution of the charge z on the left side of the peak PX then the peaks of the isotope distribution have the theoretical m/z values:

$$m/z(z)_k = m/z(PX) + k * \Delta m/z$$

$$\text{with } k = (-1, 0, 1 \ldots, 4, 5, 6)$$

In detail:

$$m/z(z)_{-1} = m/z(PX) - \Delta m/z$$

$$m/z(z)_0 = m/z(PX)$$

$$m/z(z)_1 = m/z(PX) + \Delta m/z$$

$$m/z(z)_2 \leq m/z(PX) + 2 * \Delta m/z$$

$$m/z(z)_3 \leq m/z(PX) + 3 * \Delta m/z$$

$$m/z(z)_4 \leq m/z(PX) + 4 * \Delta m/z$$

$$m/z(z)_5 \leq m/z(PX) + 5 * \Delta m/z$$

$$m/z(z)_6 \leq m/z(PX) + 6 * \Delta m/z$$

Then all peaks of the isotope distribution assigned to the peak PX and the charge z are identified in the measured mass spectrum assigned to the investigated fraction of the measured m/z values.

For each peak therefore a search window is defined around their theoretical m/z values defined before.

In a preferred embodiment of the inventive method the search window for a peak of the isotope distribution having the theoretical m/z value $m/z(z)_k$ is defined, for a positive k value by:

$$m/z(z)_k - k * \delta\Delta m_{low}/z \leq m/z \leq m/z(z)_k + k * \delta\Delta m_{high}/z$$

The values $\delta\Delta m_{low}$ and $\delta\Delta m_{high}$ are correlated to the possible deviation of the of mean isotope mass difference Δm of the peaks an isotope distribution to lower masses and higher masses.

Typical values of $\delta\Delta m_{low}$ are between 0.004 and 0.007, preferably between 0.005 and 0.006. Typical values of $\delta\Delta m_{high}$ between 0.003 and 0.006, preferably between 0.0035 and 0.0045.

For each defined peak of an isotope distribution in the search window of m/z values around the theoretical m/z values $m/z_k$ the peak of highest intensity is identified and assigned to this peak. For this peaks the intensity $I_k(z)$ and the real observed m/z values $m/z(z)_{k\ obs}$ are determined.

Only peaks having an intensity, which is not smaller than an percentage of the intensity of the highest peak PX of the investigated isotope distribution, are taken into account for further evaluation of the charge score $cs_{PX}(z)$. Typically the percentage of the intensity of the highest peak PX, which peaks taken into account should have is between 2% and 10%, particularly between 3% and 6%.

In one embodiment of the invention also peaks are taken into account which are located at the border of the search window of m/z values and cannot be identified as a real peak having a maximum compared to its surrounding in this case not the peak at the border is assumed to the searched peak of the isotope distribution. Then next peak outride the border of the search window of m/z values is identified to the searched peak of the isotope distribution, because this case a flank of this peak is located at the border of the search window of m/z values. Also for this peaks the intensity $I_k(z)$and the real observed $m/z(z)_{k\ obs}$ are determined.

In a preferred embodiment of the invention method the charge score $cs_{PX}(z)$ of a measured peak PX can be deduced from at least three sub charge scores $cs_{i_PX}(z)$.

In one embodiment charge score $cs_{PX}(z)$ of a measured peak PX can be deduced by multiplication of the at least three sub charge scores $cs_{i_PX}(z)$.

In a preferred embodiment charge score $cs_{PX}(z)$ of a measured peak PX can be deduced bs multiplication of four sub charge scores $cs_{i_PX}(z)$ with i=1, 2, 3, 4.

$$cs_{PX}(z)=cs_{i_PX}(z)*cs_{2_PX}(z)*cs_{3_PX}(z)*cs_{4_PX}(z)$$

One possibility to evaluate a sub charge score $cs_{P_PX}(z)$ which can be used in the inventive method is the use of the Patterson function This method is described in M. W. Senko et al., J. Am. Soc. Mass Spectrom. 1995, 6, 52-56.

In general this sub charge score is calculated by:

$$\text{CSP_PX}(Z) = \sum_{j=-N_{left_{PX}}(z)+1}^{N_{right_PX}(z)} I_{j-1}(z) * I_j(z)$$

In a preferred embodiment m the calculation of the sub charge score $cs_{P_PX}(z)$ the deviation of the observed m/z values $m/z(z)_{k-obs}$ from the theoretical m/z values $m/z(z)_k$ for each peak of an isotope distribution is taken into account by defining corrected intensities $I_{corr_k}(z)$ for each peak of a isotope distribution, $$I_{corr_k}(z)=I_k(z)*(1-2*((m/z(z)_{k-obs}-m/z(z)_k)/W_k)^2)$$

$W_k$ is the full-width at half maximum (FWHM) of the peak of the isotope distribution having the theoretical m/z value $m/z(z)_k$.

Only those corrected intensities $I_{corr_k}(z)$ are used which ate above the noise level in the m/z range of the observed m/z value $m/z(z)_{k-obs}$. Otherwise the corrected intensities $I_{corr_k}(z)$ is set to the the noise level in the m/z range of the observed m/z value $m/z(z)_{k-obs}$.

Then the sub charge score is calculated by:

$$\text{CSP_PX}(Z) = \sum_{j=-N_{left_{PX}}(z)+1}^{N_{right_PX}(z)} I_{corr_j-1}(z) * I_{corr_j}(z)$$

One second possibility to evaluate a sub charge score $cs_{AS_PX}(z)$ which can be used in the inventive method is the use of an accuracy score. This method is described in Z. Zhang and A. G. Marshall, J. Am. Soc. Mass Spectrom. 1998, 9, 225-223.

At first for each peak of the isotope distribution an Z score is defined. This value is describing the ratio between the maximum deviation possible for a peak of the isotope distribution and the real deviation of the real observed m/z values $m/z(z)_{k_obs}$ from the theoretical value $m/z(z)_k$. The Z score $Z_k(z)$ is given by:

$$Z_k(z)=\delta m/z_{max}*m/z_{PX}/|m/z(z)_{k_{obs}}-m/z(z)_k|$$

$\delta m/z_{max}$ is the maximum relative deviation of the m/z of the mass spectrometer used to measure the mass spectrum of the sample.

Preferably the Z Zscore $Z_k(z)$ is limited to a specific range of values. This may be e.g. a range of the value between 1 and 5.

Then the sub charge score $cs_{AS_PX}(z)$ is evaluated by summing up the Zscore values of all peaks of the invests gated isotope distribution $$\text{CSAS_PX}(Z) = \sum_{j=-N_{left_{PX}}(z)}^{N_{right_PX}(z)} Z_k(z).$$

One third possibility to evaluate a sub charge score $cs_{AC_PX}(z)$ which can be used in the inventive method is the use of an autocorrelation function, which rates the fluctuations in the peaks of the isotope distribution.

For the the calculation of this sub charge score again the above described corrected intensities $I_{corr_k}(z)$ for each peak of a isotope distribution is used.

The sub charge score $cs_{AC_PX}(z)$ is calculated by:

$$\text{CSAC_PX}(Z) = \sum_{j=-N_{left_{PX}}(z)+1}^{N_{right_PX}(z)} I_{corr_j-1}(z) * I_{corr_j}(z) \Big/ \sum_{j=-N_{left_{PX}}(z)}^{N_{right_PX}(z)} I_{corr_j}(z)^2$$

This charge score is preferably used only for isotope distributions having at least 3 peaks, preferably 4 peaks. Otherwise the charge score is set to the value 1.

One fourth possibility to evaluate a sub charge score $cs_{IS_PX}(z)$ which can be used in the inventive method is the use of an isotope score. This score puts the number of observed peaks $N_{obs_PX}(z)$ of an isotope distribution in relation to the number of theoretically expected peaks $N_{theo_PX}(z)=N_{left_PX}(z)+N_{left_PX}(z)+1$.

The sub charge score $cs_{IS_PX}(z)$ may be calculated by:

$$Cs_{IS_PX}(z)=(N_{obs_PX}(z)+0.5)/(N_{theo_PX}(z)-1).$$

In a preferred embodiment of the inventive method the charge score $cs_{PX}(z)$ of a measured peak PX is deduced by multiplication of at least three of the four sub charge scores $cs_{P_PX}(z)$, $cs_{AS_PX}(z)$, $cs_{AC_PX}(z)$ and $cs_{IS_PX}(z)$.

In a particular preferred embodiment of the inventive method the charge score $cs_{PX}(z)$ of a measured peak PX is deduced by multiplication of four sub charge scores $cs_{P_PX}(z)$, $cs_{AS_PX}(z)$, $cs_{AC_PX}(z)$ and $cs_{IS_PX}(z)$.

$$cs_{PX}(z)=cs_{P_PX}(z)*cs_{AS_PX}(z)*cs_{AC_PX}(z)*cs_{IS_PX}(z)$$

After for each charge state z between the charge 1 and the maximum charge state $z_{max}$ a score value, the charge score $cs_{P1}(z)$ for the peak P1, the peak of the highest intensity, is evaluated from mass spectrum in the investigated fraction of measured m/z values, the charge score $cs_{P1}(z)$ for the peak P1 are ranked. Then the charge score of the highest value $cs_{P1}(z_1)$ of the charge state $z_1$ is compared with the charge score of the second highest value $cs_{P1}(z_2)$ of the charge state $z_2$. If the ratio of these values is above a threshold $T_{cs}$, the charge state $z_1$ is accepted as the correct charge state of the peak P1 and his related isotope distribution.

$$cs_{P1}(z_1)/cs_{P1}(z_2)>T_{cs}$$

So if the charge state $z_1$ is accepted it is deduced from the peak P1 of the measured mass spectrum and its surrounding mass spectrum its related isotope distribution having peaks of the intensity $I_k(z_1)$ and the real observed m/z values $m/z(z_1)_{k_obs}(k=(-N_{left_PX}(z_1), \ldots, N_{right_PX}(z_1)))$ and the specific charge $z_1$. This isotope distribution is the isotope distribution of ions of a species of molecules. The species of molecules is either contained in the investigated sample which have been charged by an ionisation process without changing its mass or the ions of a species of molecules are originated from a sample by at least an ionisation process.

By the value of the threshold $T_{cs}$ it can be defined how dearly the best two evaluated charge scores $cs_{P1}(z_1)$ and $cs_{P1}(z_2)$ having the highest values have to differ that the isotope distribution related to the charge state $z_1$ can unambiguously deduced as the isotope distribution comprising the peak P1. Typically the value of the threshold $T_{cs}$ is in the range of 1.10 and 3, preferably in the range of 1.15 and 2 and preferably in the range of 1.20 and 1.50. The value of the threshold $T_{cs}$ can be set by the user, the controller or the producer of the controller by hardware or software.

From the deduced isotope distribution ions of a species of molecules of the specific charge $z_1$ the monoisotopic mass of the species of molecules and/or the monoisotopic peak of the species of molecules can be deduced by methods known by a person skilled in the art e.g. by an avergine fit to the pattern of the peaks of the isotope distribution or looking directly for the monoisotopic peak in the isotope pattern of the isotope distribution.

After isotope distribution comprising the peak P1 could be deduced the peaks of this isotope distribution are removed from the significant peaks in the fraction. Then the peak of highest intensity of the remaining significant peaks of the fraction is defined. For this peak P2 then in the same way as for peak 1 the maximum charge state $z_{max}$ has to be defined, for each charge state z between the charge 1 and the maximum charge state $z_{max}$ the charge scores $cs_{P2}(z)$ have to be evaluated from mass spectrum in the investigated fraction of measured m/z values and it has to be checked if the charge score of the highest value $cs_{P2}(z_1)$ accepted as the correct charge state of the peak P2. By repeating this procedure as much as possible as much as possible isotope distribution of ions of species of molecules having a specific charge Z and also monoisotopic masses of the species of molecules can be deduced from a fraction of the at least one range of measured m/z values of the mass spectrum by one single processor.

Preferably this is done for all fractions of the at least one range of measured m/z values of the mass spectrum having a significant peak by their assigned processors.

So from the whole m/z range of the at least one range of measured m/z values isotope distributions of ions of species of molecules having a specific charge can be deduced fraction by fraction by parallel deducing with several processors of a multiprocessor. By dividing the at least one range of measured m/z values which shall be investigated in fractions and assigning these fractions to the several processors the deducing isotope distributions the whole m/z range of the at least one range of measured m/z values can be done much faster and also the deducing of monoisotopic masses from the deduced isotope distributions. Particularly the deduced monoisotopic masses can be used to define specific species of molecules which shall be investigated further with a second mass analyser. Especially for this experiments the inventive method is very helpful because the information of the monoisotopic mass of a specific molecule is now available in a shorter time. Before the specific species of molecules which shall be investigated further with a second mass analyser is provided to the mass analyser It may be convert into another molecule by typical processes used in $MS^2$ or $MS^N$ mass spectrometry like fragmentation, dissociation e.g. in a collision cell or reaction cell.

In another possible step of the inventive method from at least one deduced isotope distribution of each of the at least one species of molecules contained in the sample and/or originated from a sample the monoisotopic mass of the species of molecules is deduced. In an embodiment of the inventive method the monoisotopic mass of the species of molecules contained in the sample and/or originated from the investigated sample is deduced from the isotope distribution of the species of molecules immediately after the deducing of the isotope distribution. In this embodiment it is may be provided that the monoisotopic mass of one species of molecules is deduced before isotope distribution of another species of molecules is deduced. In one embodiment of the inventive method it is provided that the deduction of monoisotopic mass of some species of molecules happens before the deduction of isotope distribution of other species of molecules.

In general, the step (iv) of the inventive method, the deducting of isotope distributions, and step (v), the deducing of monoisotopic masses, may happen in some embodiments of the inventive method in parallel.

In a preferred embodiment of the inventive method for some of the species of molecules contained in the sample and/or originated from a sample by at least an ionisation process the monoisotopic mass is deduced from two or more deduced isotope distributions of their ions having a different specific charge z.

After isotope distributions of ions of species of molecules having a specific charge z are be deduced fraction from the whole m/z range of the at least one range of measured m/z values by fraction by parallel deducing with several processors of a multiprocessor, it is possible that two or more of the deduced isotope distributions are isotope distributions of ions of one species of molecules which have different specific charges z. Mostly these isotope distributions have been deduced in different fractions of the at least one range of measured m/z values. But these isotope distributions may also have been deduced one fraction of the at least one range of measured m/z values. It is also possible that one isotope distributions of ions of one species of molecules having a specific charge z has been identified when the isotope distributions are deduced from the fractions of the at least one range of measured m/z values and another isotope distributions of ions of the same species of molecules having another specific charge z' has not been deduced from the fractions of the at least one range of measured m/z values.

In general different ions of one species of molecules which are detectable by a mass spectrometer can vary in the following manner:

(i) only the charge of the different ions is deviating and the mass is the same. This kind of ions may be arise of electrons are added or removed by a ionisation process.

Example: Addition of an electron (charge z=−1)

First ion: mass m charge z

Second ion: mass m charge z−1

(ii) addition of ions with the mass $m_a$ and the charge $z_a$

Example: Addition of an ion with the mass and the charge $z_a$

First ion: mass m charge z

Second ion: mass $m+m_a$ charge $z+z_a$

Typical adducts, which are added as ions, are $H^+$, $Na^+$, $K^+$ and ions of acetic acid and formic acid.

During electrospray ionisation protons ($H^+$) having the mass m=1 and charge z=1 are added: Two resulting ions with or without an added proton are:

First ion: mass m charge z

Second ion: mass m+1 charge z+1

The possible occurrence of isotope distributions of ions of the same molecule having a different specific charge can be used in another step of the inventive method to improve the determination of the monoisotopic mass of the species of molecules.

At first from all isotope distributions of ions of species of molecules having a specific charge z are be deduced fraction from the whole m/z range of the at least one range of measured m/z values the isotope distribution of species of molecules M1 is defined for which the highest value of a charge score $cs_{M1}(z)$ was found when is isotope distribution was deducted from a fraction of the at least one range of measured m/z values. For this molecule M1 the isotope distributions of the ions with S charge scores $cs_{M1}(z_i)$ . . . $cs_{M1}(z_s)$ having the highest S values are investigated. Typically the number of the investigated charge scores is between 2 and 8, preferably between 4 and 6. For each if this isotope distributions of the ions of the specific molecule having the specific charge z the neighbouring isotope distributions of the ions of specific species of molecules having a charge which is between z−Δz and z+Δz are taken into account. A typical value of Δz is between 1 and 5, preferably it is 2 or 3. So for Δz=2 the ions having the charge z−2, z−1, z, z+1, z+2 are taken into account. It has to be also taken into account that depending on the ionisation process of the ions of the species of molecules also the mass of the ions can change as described above A new charge score $cs_{M1_A}(z_x)$ of the isotope distributions of the ions with S charge scores $cs_{M1}(z_1)$ . . . $cs_{M1}(z_s)$ is calculated by adding to the charge score the charge score of the neighbouring isotope distributions taken into account.

For example:

$$cs_{M1_A}(z_1)=cs_{M1}(z_1\Delta z)+\ldots+cs_{M1}(z_1)+\ldots+cs_{M1}(Z1+\Delta z)$$

If the neighbouring isotope distributions of the ions of specific species of molecules has e been already deduced from a fraction of the at least one range of measured m/z values the evaluated charge scores of the deduced isotope distributions can be used. Otherwise from the m/z value $m_h/z_h$ of the highest peak of the investigated isotope distribution it is possible to conclude on the m/z values of the highest peak of the neighbouring isotope distributions taken into account how different ions of one species of molecules can vary depending on their ionisation as described above. E.g. for electrospray ionisation the neighboring peak of the charge z+Δz has the m/z value $(m_h+\Delta z)/(z_h+\Delta z)$.

A search window for the highest peak of the neighbouring isotope distribution having the theoretical m/z value $m/z_n$ is be defined by.

$$m/z_n-\delta m/z_{iso}\leq m/z\leq m/z_n+\delta m/z_{iso}$$

The window width $2*\delta m/z_{iso}$ can be chosen depending on the charge of the neighbouring isotope distribution and/or the maximum deviation of the mass of the observed and expected highest peak of the neighbouring isotope distribution.

For this highest peak PN of the neighbouring isotope distribution observed in the search window the other peaks of the isotope distribution have to be identified and a charge score $cs_{PN}(z_n)$ according to his charge $z_n$ has to be evaluated according to the methods described above to deduce isotope distributions in the fractions of the at least one range of measured m/z values. These charge scores $cs_{PN}(z_n)$ are then used in the calculation of the new charge scores $cs_{M1_A}(z_x)$. The identification of the missing neighbouring isotope distributions and evaluation of the charge score $cs_{PN}(z_n)$ can be done in parallel of different processors of a multiprocessor to accelerate the process.

If the new charge scores $cs_{M1_A}(z_x)$ of the isotope distributions of the ions with the S charge scores $cs_{M1}(z_1)$ . . . $cs_{M1}(z_s)$ have been calculated, new charge scores $cs_{M1_A}(z_x)$ are ranked. Then the charge score of the highest value $cs_{M1_A}(z_{H1})$ of the charge state $z_{H1}$ is compared with the charge score of the second highest value $cs_{M1_A}(z_{H2})$ of the charge state $z_{H2}$. If the ratio of these values is above a threshold $T_{cs2}$, the charge state $z_{H1}$ is accepted as the correct starting charge state of the species of molecules M1 to define the correct set of related isotope distributions of the species of molecules M1.

$$cs_{M1_A}(z_{H1})/cs_{M1_A}(z_{H2})>T_{cs2}$$

By the value of the threshold $T_{cs2}$ it can be defined how clearly the best two evaluated charge scores $cs_{M1_A}(z_{H1})$ and $cs_{M1_A}(z_{H1})$ having the highest values have to differ that the set of isotope distributions related to the starting charge state $z_{H1}$ can unambiguously deduced as set of the isotope distributions of the species of molecules M1. Typically the value of the threshold $T_{cs2}$ is in the range of 1.10 and 3, preferably in the range of 1.15 and 2 and preferably in the range of 1.20 and 1.50. The value of the threshold $T_{cs2}$ can be set by the user, the controller or the producer of the controller by hardware or software.

From the deduced set of isotope distribution ions of the species of molecules M1 the monoisotopic mass of the species of molecules M1 and/or the monoisotopic peak of the species of molecules M1 can be deduced by methods known by a person skilled in the art e.g. by an avergine fit to the pattern of the peaks of the isotope distribution or looking directly for the monoisotopic peak in the isotope pattern of the isotope distribution.

After set of isotope distributions of the species of molecules M1 could be deduced the peaks of this set of isotope distributions are removed from all significant peaks in from the whole in z range of the at least one range of measured m/z values.

Then from all remaining isotope distributions of ions of species of molecules having a specific charge z which be deduced fraction from the whole m/z range of the at least one range of measured m/z values whose significant peaks have not been removed the isotope distribution of the species of molecules M2 is defined for which the highest value of a charge score $cs_{M2}(z)$ was found when is isotope distribution was deducted from a fraction of the at least one range of measured m/z values. For this molecule M2 the isotope distributions of the ions with S charge scores $cs_{MS}(z_1)$ . . . $cs_{M2}(z_s)$ having the highest S values are investigated.

For this species of molecules M2 then in the same way as for the species of molecules peak M1 as set of the isotope distributions has to be deduced.

From the deduced set of isotope distribution ions of the species of molecules M2 the monoisotopic mass of the species of molecules M2 and/or the monoisotopic peak of the species of molecules M2 can be deduced by methods known by a person skilled in the art e.g. by an avergine fit to the pattern of the peaks of the isotope distribution or looking directly for the monoisotopic peak in the isotope pattern of the isotope distribution.

By repeating this procedure as often as possible as many sets as possible of isotope distributions of ions of species of molecules and also as many monoisotopic masses as possible of the species of molecules can be deduced.

To the content of this description of the invention belong also all embodiments which are combinations of the before mentioned embodiments of the invention. So all embodiments are encompassed which comprise a combinations of features described just for single embodiments before.

In all described embodiments the Avergine model is used as the model of expected isotope distribution. It is obvious for a person skilled in the art that he can also use other models of the expected isotope distribution according to the investigated molecules in the inventive method.

What is claimed is:

1. A method for identifying an intact protein within a sample containing a plurality of intact proteins using a mass spectrometer, the method comprising:

(a) introducing the sample to an ionization source of the mass spectrometer;

(b) using the ionization source, generating a plurality of ion species from the plurality of intact proteins, whereby each protein gives rise to a respective subset of the plurality of ion species, wherein each ion species of each subset is a multi-protonated ion species generated from a respective one of the intact proteins;

(c) performing a mass analysis of the plurality of ion species using a mass analyzer of the mass spectrometer;

(d) automatically recognizing each subset of the plurality of ion species and assigning a charge state, z, to each recognized ion species and a molecular weight, MW, to each intact protein by mathematical analysis of data generated by the mass analysis;

(e) selecting a one of the ion species;

(f) automatically calculating a collision energy, CE, to be employed for fragmentation of the selected ion species, using the relationship $$CE(D_p)=c+(1/k)[\ln(1/D_p)-1],$$

where $D_p$ is a portion of the selected ion species that is desired to remain unfragmented after the fragmentation and c and k are functions only the charge state, z, of the selected ion species and the molecular weight, MW, of the intact protein from which the selected ion species was generated;

(g) isolating the selected ion species and fragmenting said species so as to form fragment ion species therefrom using the automatically calculated collision energy; and (h) mass analyzing the fragment ion species.

2. A method for identifying an intact protein within a sample containing a plurality of intact proteins using a mass spectrometer, the method comprising:

(a) introducing the sample to an ionization source of the mass spectrometer;

(b) using the ionization source, generating a plurality of ion species from the plurality of intact proteins, whereby each protein gives rise to a respective subset of the plurality of ion species, wherein each ion species of each subset is a multi-protonated ion species generated from a respective one of the intact proteins;

(c) performing a mass analysis of the plurality of ion species using a mass analyzer of the mass spectrometer;

(d) automatically recognizing each subset of the plurality of ion species and assigning a charge state, z, to each recognized ion species and a molecular weight, MW, to each intact protein by mathematical analysis of data generated by the mass analysis;

(e) selecting a one of the ion species;

(f) automatically calculating a collision energy, CE, to be employed for fragmentation of the selected ion species, using the relationship $$CE(D_E)=b_1\times MW^{b_2}\times z^{b_3},$$

where $D_E$ is a parameter that corresponds to a desired distribution of fragment ion species to be generated by the fragmentation, z is the assigned charge state of the selected ion species, MW is the molecular weight of the intact protein from which the selected ion species was generated $b_1$, and $b_2$ and $b_3$ are pre-determined parameters that vary according to $D_E$;

(g) isolating the selected ion species and fragmenting said species so as to form fragment ion species therefrom using the automatically calculated collision energy; and (h) mass analyzing the fragment ion species.

* * * * *